US010923307B1

(12) United States Patent
Yabushita et al.

(10) Patent No.: US 10,923,307 B1
(45) Date of Patent: Feb. 16, 2021

(54) ELECTRON BEAM GENERATOR

(71) Applicant: HAMAMATSU PHOTONICS K.K., Hamamatsu (JP)

(72) Inventors: Ryosuke Yabushita, Hamamatsu (JP); Atsushi Ishii, Hamamatsu (JP)

( * ) Notice: Subject to any disclaimer, the term of this patent is extended or adjusted under 35 U.S.C. 154(b) by 0 days.

(21) Appl. No.: 16/846,406

(22) Filed: Apr. 13, 2020

(51) Int. Cl.
*H01J 35/04* (2006.01)
*H01J 35/14* (2006.01)

(52) U.S. Cl.
CPC ..... *H01J 35/045* (2013.01); *H01J 35/153* (2019.05)

(58) Field of Classification Search
None
See application file for complete search history.

(56) References Cited

U.S. PATENT DOCUMENTS

| | | | | |
|---|---|---|---|---|
| 2003/0099327 | A1* | 5/2003 | Matsushita | H01J 35/06 378/138 |
| 2005/0117704 | A1* | 6/2005 | Tekletsadik | H01J 35/06 378/119 |
| 2010/0080359 | A1 | 4/2010 | Sakabe | |
| 2014/0029729 | A1 | 1/2014 | Kucharczyk | |
| 2016/0268095 | A1 | 9/2016 | Canfield et al. | |
| 2016/0365218 | A1* | 12/2016 | Takahashi | H01J 35/165 |
| 2018/0247787 | A1* | 8/2018 | Jeong | H01J 35/045 |

FOREIGN PATENT DOCUMENTS

| | | |
|---|---|---|
| JP | H11-144653 | 5/1999 |
| JP | 2002-343289 | 11/2002 |
| JP | 2006-164819 | 6/2006 |
| JP | 5248254 | 7/2013 |
| JP | 2014-026964 | 2/2014 |
| JP | 2015-041585 | 3/2015 |
| JP | 2018-106899 | 7/2018 |
| JP | 6527239 | 6/2019 |

* cited by examiner

*Primary Examiner* — Hoon K Song
(74) *Attorney, Agent, or Firm* — Soei Patent & Law Firm

(57) ABSTRACT

An electron beam generator includes a cathode having a distal end portion emitting an electron beam, a first electrode accommodating the distal end portion, and a second electrode surrounding the first electrode when viewed from a direction along an emission axis of the electron beam. The first electrode has a first side wall surrounding the distal end portion. The second electrode has a second side wall separated from the first side wall and surrounding the first side wall. The first side wall is provided with a first opening portion allowing a first space surrounded by the first side wall and a second space between the first side wall and the second side wall to communicate with each other. The second electrode is provided with a second opening portion opening in the direction along the emission axis such that the second space and an external space communicate with each other.

20 Claims, 16 Drawing Sheets

ELECTRON BEAM GENERATOR

TECHNICAL FIELD

Aspects of the present disclosure relate to an electron gun and an X-ray generation apparatus.

BACKGROUND

Known X-ray generation devices emit an electron beam to be incident on a target. For example, Japanese Unexamined Patent Publication No. 2015-041585 discloses the configuration of an electron gun in which a cathode is accommodated in a Wehnelt electrode (grid electrode).

The Wehnelt electrode is provided with an opening through which the electron beam passes. The cathode may be consumed by a gas that remains in a space in which the cathode is accommodated in the grid electrode.

SUMMARY

Example electron beam generators disclosed herein comprise an electron gun and/or an X-ray generation apparatus including a cathode accommodating space that can be efficiently evacuated.

An example electron gun disclosed herein includes a cathode having a distal end portion configured to emit an electron beam, a first electrode accommodating the distal end portion of the cathode, and a second electrode surrounding the first electrode when viewed from a direction along an emission axis of the electron beam. The first electrode has a first side wall surrounding the distal end portion around the emission axis. The second electrode has a second side wall separated from and surrounding the first side wall. The first side wall is provided with a first opening portion that allows a first space surrounded by the first side wall and a second space between the first side wall and the second side wall to communicate with and/or be fluidly coupled to each other. The second electrode is provided with a second opening portion that opens in the direction along the emission axis such that the second space and an external space communicate with and/or be fluidly coupled to each other.

In some examples, the first space in the first electrode (that is, the cathode accommodating space accommodating the cathode) communicates with the second space between the first side wall and the second side wall via the first opening portion provided in the first side wall. Further, the second space communicates with the external space via the second opening portion provided in the second electrode. As a result, a gas remaining in the cathode accommodating space is discharged to the second space via the first opening portion, and the gas discharged to the second space is discharged to the external space via the second opening portion. Accordingly, the electron gun may be configured to efficiently evacuate the cathode accommodating space.

The first opening portion may have an elongated hole shape that extends along a circumferential direction around the emission axis to evacuate the first space.

The second side wall may cover and hide the first opening portion when viewed from a direction orthogonal to the emission axis. In some examples, an edge end portion that constitutes the first opening portion or the like can be hidden with respect to a structure having a large potential difference from the electron gun, examples of which include the inner wall of a housing accommodating the electron gun. Accordingly, the occurrence of electrical discharge may be suppressed.

The electron gun may further include a third electrode having a third side wall surrounding a support portion that supports the distal end portion of the cathode around the emission axis. The third side wall may be provided with a third opening portion that allows a third space surrounded by the third side wall and the external space to communicate with and/or be fluidly coupled to each other. In some examples, a gas remaining in the cathode accommodating space (third space) accommodating the support portion supporting the distal end portion of the cathode can also be discharged to the external space via the third opening portion.

A through hole that allows the third space and at least one of the first space and the second space to communicate with and/or be fluidly coupled to each other may be provided in the electron gun. In some examples, the third space communicates with and/or is fluidly coupled to at least one of the first space and the second space to evacuate the gas.

The second side wall may surround the third side wall around the emission axis. A fourth opening portion that allows the external space and a fourth space between the second side wall and the third side wall to communicate with and/or be fluidly coupled to each other may be provided at the second side wall. The third space and the external space may communicate with and/or be fluidly coupled to each other via the fourth space. In some examples, a gas remaining in the third space can be discharged to the external space via the third opening portion, the fourth space, and the fourth opening portion in a structure in which the second side wall of the second electrode is provided so as to surround the third side wall of the third electrode.

The third opening portion and the fourth opening portion may be provided so as not to face each other. If the third opening portion and the fourth opening portion are provided such that the third opening portion cannot be visually recognized via the fourth opening portion, an edge end portion that constitutes the third opening portion or the like can be hidden with respect to a structure having a large potential difference from the electron gun to suppress the occurrence of electrical discharge. Example structures that have a large potential difference from the electron gun include the inner wall of the housing accommodating the electron gun.

An example X-ray generation apparatus may include an electron gun having the above-described structure.

In some examples disclosed herein, the cathode accommodating space in the electron beam generator, such as an electron gun, can be evacuated.

DETAILED DESCRIPTION

In the following description, with reference to the drawings, the same reference numbers are assigned to the same components or to similar components having the same function, and overlapping description is omitted.

Figure 1:
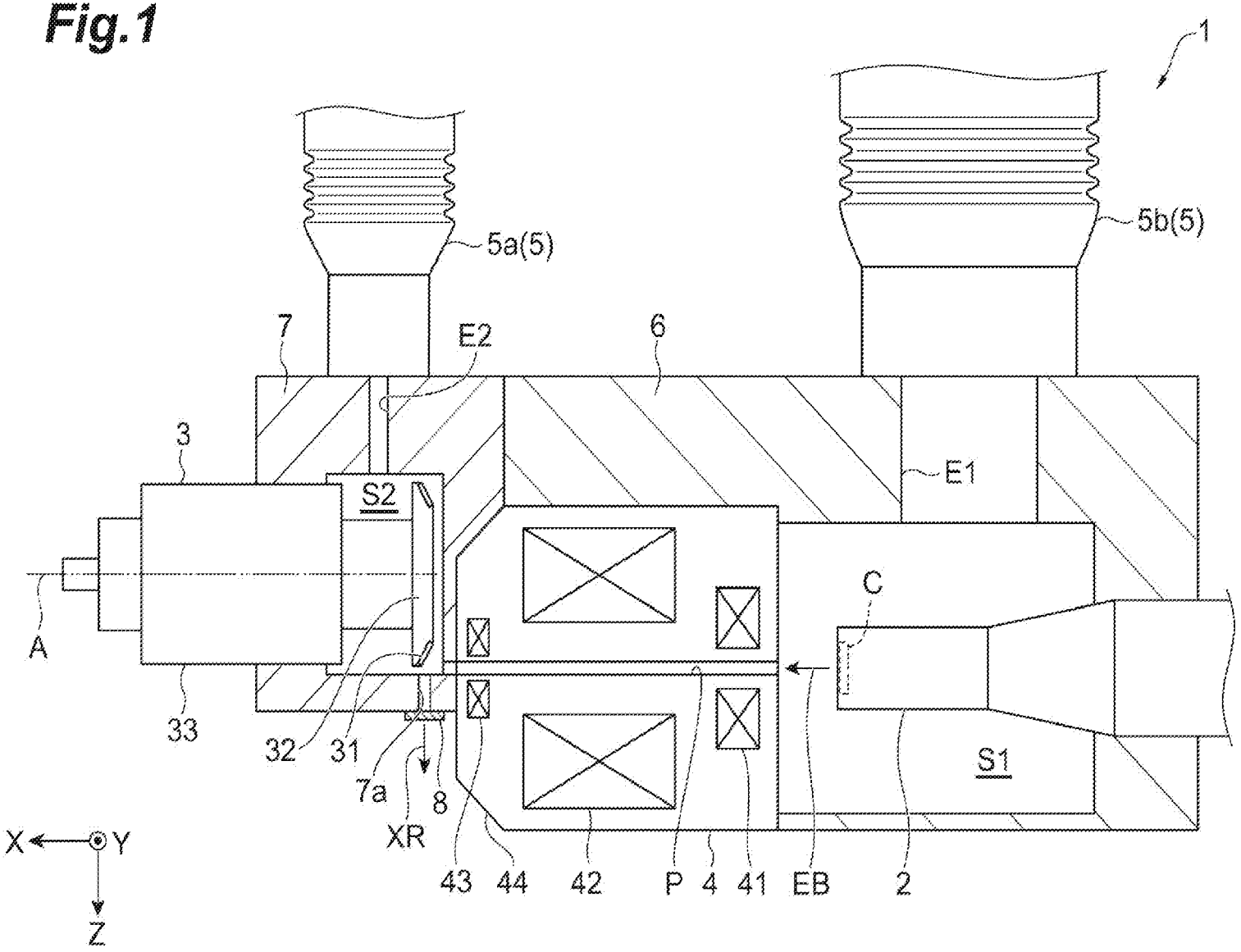
FIG. 1 is a schematic configuration diagram of an example X-ray generation apparatus.

As illustrated in FIG. 1, an example X-ray generation apparatus 1 is provided with an electron gun 2, a rotary anode unit 3, a magnetic lens 4, an exhaust unit 5, a housing 6 (first housing) defining an internal space S1 accommodating the electron gun 2, and a housing 7 (second housing) defining an internal space S2 accommodating the rotary anode unit 3. The housing 6 and the housing 7 may be configured to be detachable from each other, may be integrally coupled so as not to be detachable from each other, or may be integrally formed from the beginning.

The electron gun 2 emits an electron beam EB. The electron gun 2 has a cathode C emitting the electron beam EB. The cathode C is a circular flat cathode emitting the electron beam EB having a circular cross-sectional shape. The cross-sectional shape of the electron beam EB is taken in a direction perpendicular to an X-axis direction (first direction), which is parallel to the traveling direction of the electron beam EB that will be described in additional detail later. Accordingly, the cross-sectional shape of the electron beam EB may be understood to be taken on a YZ plane. The electron emission surface of the cathode C itself may have, for example, a circular shape when viewed from a position facing the electron emission surface of the cathode C (when the electron emission surface of the cathode C is viewed from the X-axis direction) so as to form the electron beam EB having the circular cross-sectional shape.

The rotary anode unit 3 has a target 31, a rotary support body 32, and a drive unit 33 that drives the rotary support body 32 to rotate around a rotation axis A. The target 31 is provided along the peripheral edge portion of the rotary support body 32 formed in a flat truncated cone shape. The rotation axis A is a central axis of the rotary support body 32, such that the side surface of the truncated cone-shaped rotary support body 32 has a surface inclined with respect to the rotation axis A. Additionally, the rotary support body 32 may be formed in an annular shape having the rotation axis A as a central axis. The material that constitutes the target 31 may comprise, for example, a heavy metal such as tungsten, silver, rhodium, molybdenum, or an alloy thereof. The rotary support body 32 is rotatable around the rotation axis A. The material that constitutes the rotary support body 32 may comprise, for example, a metal such as copper or a copper alloy. The drive unit 33 has a drive source, such as a motor, that drives the rotary support body 32 to rotate around the rotation axis A. The target 31 receives the electron beam EB while rotating with the rotation of the rotary support body 32. An X-ray XR is generated as a result. The X-ray XR is emitted outside of the housing 7 from an X-ray passage hole 7*a* formed in the housing 7. A window member 8 forms an air-tight seal at the X-ray passage hole 7*a*. The axial direction of the rotation axis A is parallel to the incident direction of the electron beam EB on the target 31. Alternatively, the rotation axis A may be inclined with respect to the incident direction of the electron beam EB on the target 31 so that the rotation axis A may extend in a direction intersecting with the incident direction. The target 31, which may comprise a reflective target, emits the X-ray XR in a direction intersecting with the traveling direction of the electron beam EB (direction of incidence on the target 31). In some examples, the emission direction of the X-ray XR is orthogonal to the traveling direction of the electron beam EB. Accordingly, it may be understood that the X-axis direction (first direction) is parallel to the traveling direction of the electron beam EB, a Z-axis direction (second direction) is parallel to the emission direction of the X-ray XR from the target 31, and a Y-axis direction (third direction) is orthogonal to the X-axis direction and the Z-axis direction.

Figure 2:
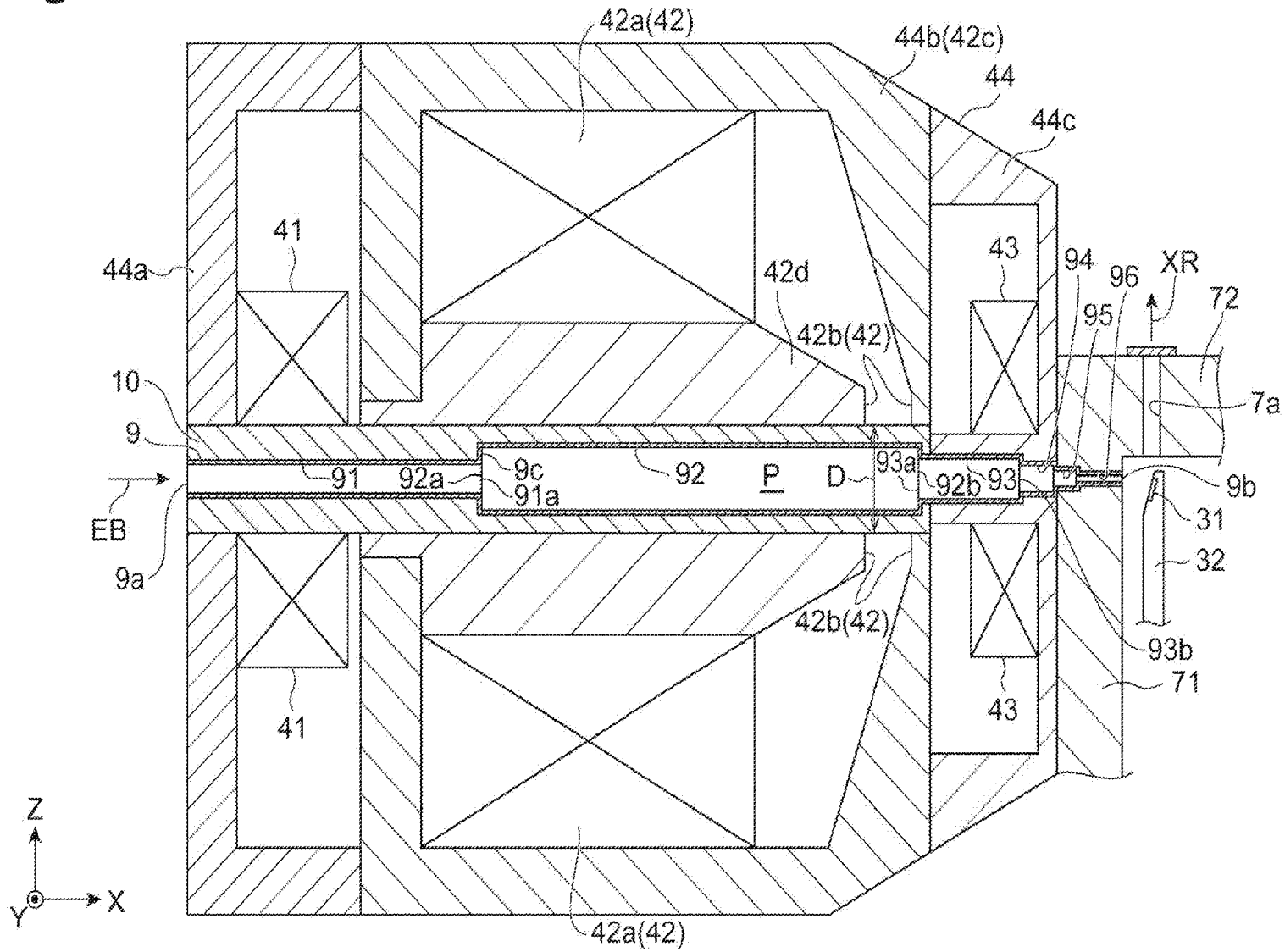
FIG. 2 is a schematic cross-sectional view illustrating an example configuration of a magnetic lens of the X-ray generation apparatus.

The magnetic lens 4 controls the electron beam EB. The magnetic lens 4 has a deflection coil 41, a magnetic focusing lens 42, a magnetic quadrupole lens 43, and a housing 44. The housing 44 accommodates the deflection coil 41, the magnetic focusing lens 42, and the magnetic quadrupole lens 43. The deflection coil 41, the magnetic focusing lens 42, and the magnetic quadrupole lens 43 are located within the housing 44, in this order, from a direction of the electron gun 2 toward the target 31 along the X-axis. An electron passage P through which the electron beam EB passes is formed between the electron gun 2 and the target 31. As illustrated in FIG. 2, the electron passage P may be formed by a cylindrical tube 9 (tubular portion). The cylindrical tube 9 is a nonmagnetic metal member extending along the X-axis direction between the electron gun 2 and the target 31. Additional example configurations of the cylindrical tube 9 will be described in further detail later.

The deflection coil 41, the magnetic focusing lens 42, and the magnetic quadrupole lens 43 are directly or indirectly connected to the cylindrical tube 9. For example, the central axis of the deflection coil 41, the central axis of the magnetic focusing lens 42, and the central axis of the magnetic quadrupole lens 43 are coaxially disposed with high precision by the deflection coil 41, the magnetic focusing lens 42, and the magnetic quadrupole lens 43 being assembled with respect to the cylindrical tube 9 as a reference. Accordingly, the central axis of the deflection coil 41, the central axis of the magnetic focusing lens 42, and the central axis of the magnetic quadrupole lens 43 coincide with the central axis of the cylindrical tube 9 (axis parallel to the X axis).

The deflection coil 41 is located between the electron gun 2 and the magnetic focusing lens 42. The deflection coil 41 is disposed so as to surround the electron passage P. In some examples, the deflection coil 41 is indirectly connected to the cylindrical tube 9 via a tube member 10. The tube member 10 is a nonmagnetic metal member extending coaxially with the cylindrical tube 9. The tube member 10 is provided so as to cover the outer periphery of the cylindrical tube 9. The deflection coil 41 is positioned by the outer peripheral surface of the tube member 10 and the surface of a wall portion 44*a* that is on the target 31 side. The wall portion 44*a*, which is made of a nonmagnetic material, is a part of the housing 44 provided at a position facing the internal space S1. The deflection coil 41 adjusts the traveling direction of the electron beam EB emitted from the electron gun 2. One deflection coil (one set of deflection coils) or two deflection coils (two sets of deflection coils) may constitute the deflection coil 41. In the former case that involves one deflection coil, the deflection coil 41 may be configured to correct an angular deviation between the emission axis of the electron beam EB emitted from the electron gun 2 and the central axis of the magnetic focusing lens 42 and the magnetic quadrupole lens 43 (axis parallel to the X axis). For example, the angular deviation may occur in a case where the emission axis and the central axis intersect with each other at a predetermined angle. Accordingly, the angular deviation may be eliminated by changing the traveling direction of the electron beam EB to a direction along the central axis by means of the deflection coil 41. In the latter case that involves two deflection coils, two-dimensional deflection can be performed by the deflection coil 41 in order to correct not only the angular deviation but also a lateral offset between the emission axis and the central axis (such as when the emission axis and the central axis are parallel to each other in the X-axis direction and separated from each other in one or both of the Y-axis and Z-axis directions).

The magnetic focusing lens 42 is located downstream of the electron gun 2 and the deflection coil 41. The magnetic focusing lens 42 focuses the electron beam EB while rotating the electron beam B around an axis along the X-axis direction. In some examples, the electron beam EB passing through the magnetic focusing lens 42 is focused while rotating in a spiral shape. The magnetic focusing lens 42 has a pole piece 42*b*, a yoke 42*c*, a yoke 42*d*, and a coil 42*a* disposed so as to surround the electron passage P. The yoke 42*c* also functions as a wall portion 44*b* of the housing 44 provided so as to interconnect the tube member 10 and a part of the outside of the coil 42*a*. The yoke 42*d* is a tubular member provided so as to cover the outer periphery of the tube member 10. In some examples, the coil 42*a* is indirectly connected to the cylindrical tube 9 via the tube member 10 and the yoke 42*d*. The yoke 42*c* and the yoke 42*d* constitute the pole piece 42*b*. The yoke 42*c* and the yoke 42*d* are ferromagnetic bodies such as iron. Additionally, the pole piece 42*b* may be constituted by a notch (gap) provided between the yoke 42*c* and the yoke 42*d*, and a part of the yoke 42*c* and a part of the yoke 42*d* positioned near the notch. An inner diameter D of the pole piece 42*b* is equal to the inner diameter of the region of the yoke 42*c* or the yoke 42*d* that is adjacent to the gap. Accordingly, the magnetic focusing lens 42 may be configured such that the magnetic field of the coil 42*a* leaks from the pole piece 42*b* to the cylindrical tube 9 side.

The magnetic quadrupole lens 43 is located downstream of the magnetic focusing lens 42. The magnetic quadrupole lens 43 deforms the cross-sectional shape of the electron beam EB into an elliptical shape having a major axis along the Z-axis direction and a minor axis along the Y-axis direction. The magnetic quadrupole lens 43 is disposed so as to surround the electron passage P. In some examples, the magnetic quadrupole lens 43 is indirectly connected to the cylindrical tube 9 via a wall portion 44*c* of the housing 44. The wall portion 44*c* is connected to the wall portion 44*b* and is provided so as to cover the outer periphery of the cylindrical tube 9. The wall portion 44*c* is made of a nonmagnetic metal material.

Figure 3:
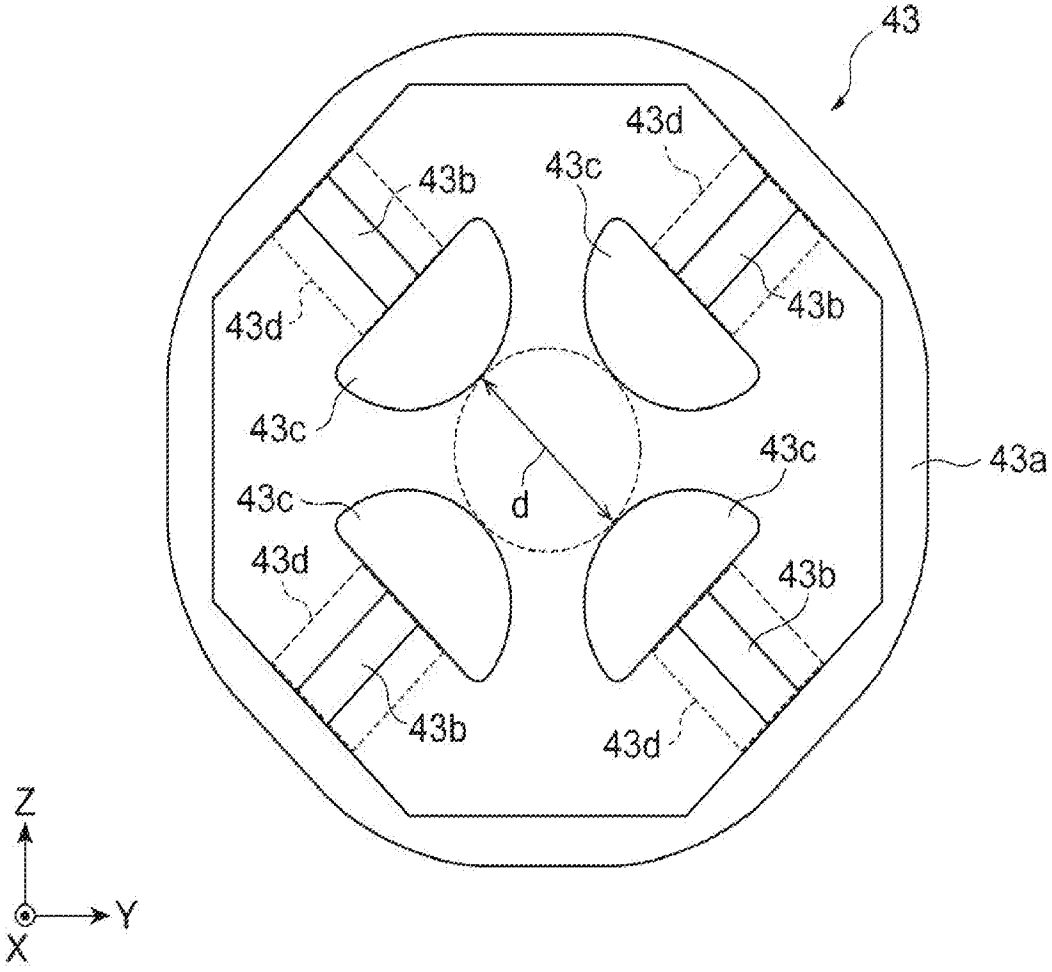
FIG. 3 is a front view of an example magnetic quadrupole lens.

As illustrated in FIG. 3, the example magnetic quadrupole lens 43 has an annular yoke 43*a*, four columnar yokes 43*b* provided on the inner peripheral surface of the yoke 43*a*, and yokes 43*c* respectively provided at the distal ends of the columnar yokes 43*b*. A coil 43*d* is wound around the columnar yoke 43*b*. The yokes 43*c* each have a substantially semicircular cross-sectional shape on the YZ plane. An inner diameter d of the magnetic quadrupole lens 43 is the diameter of an inscribed circle passing through the respective innermost ends of the yokes 43*c*. The magnetic quadrupole lens 43 functions as a concave lens on the XZ plane (plane orthogonal to the Y-axis direction) and functions as a convex lens on the XY plane (plane orthogonal to the Z-axis direction). As a result of this function of the magnetic quadrupole lens 43, the aspect ratio between the diameter (major axis X1) of the electron beam EB along the Z-axis direction and the diameter (minor axis X2) of the electron beam EB along the Y-axis direction is adjusted such that the Z-axis-direction length of the electron beam EB is greater than the Y-axis-direction length of the electron beam EB. Accordingly, the aspect ratio may be selectively modified by adjusting the amount of electric current flowing through the coil 43*d*. As an example, the aspect ratio between the major axis X1 and the minor axis X2 is adjusted to "10:1".

The exhaust unit 5 has a vacuum pump 5*a* (first vacuum pump) and a vacuum pump 5*b* (second vacuum pump). The housing 6 is provided with an exhaust flow path E1 (first exhaust flow path) for evacuating the space in the housing 6 (the internal space S1 defined by the housing 6 and the housing 44 of the magnetic lens 4). The vacuum pump 5*b* and the internal space S1 communicate (e.g., are fluidly coupled) with each other via the exhaust flow path E1. The housing 7 is provided with an exhaust flow path E2 (second exhaust flow path) for evacuating the space in the housing 7 (the internal space S2 defined by the housing 7). The vacuum pump 5*a* and the internal space S2 communicate (e.g., are fluidly coupled) with each other via the exhaust flow path E2. The vacuum pump 5*b* evacuates the internal space S1 via the exhaust flow path E1. The vacuum pump 5*a* evacuates the internal space S2 via the exhaust flow path E2. As a result, the internal space S1 and the internal space S2 are maintained in a vacuumized state or a partial vacuum, for example in order to remove any gas that is generated by the electron gun or at the target, as further described herein. The internal pressure in the internal space S1 may be preferably maintained in a partial vacuum of less than or equal to 104 Pa and may be more preferably maintained in a partial vacuum of less than or equal to 10-5 Pa. The internal pressure in the internal space S2 may be preferably maintained in a partial vacuum of between 10-6 Pa and 10 Pa. The internal space of the cylindrical tube 9 (space in the electron passage P) is also evacuated by the exhaust unit 5 via the internal space S1 or the internal space S2.

Figure 8:
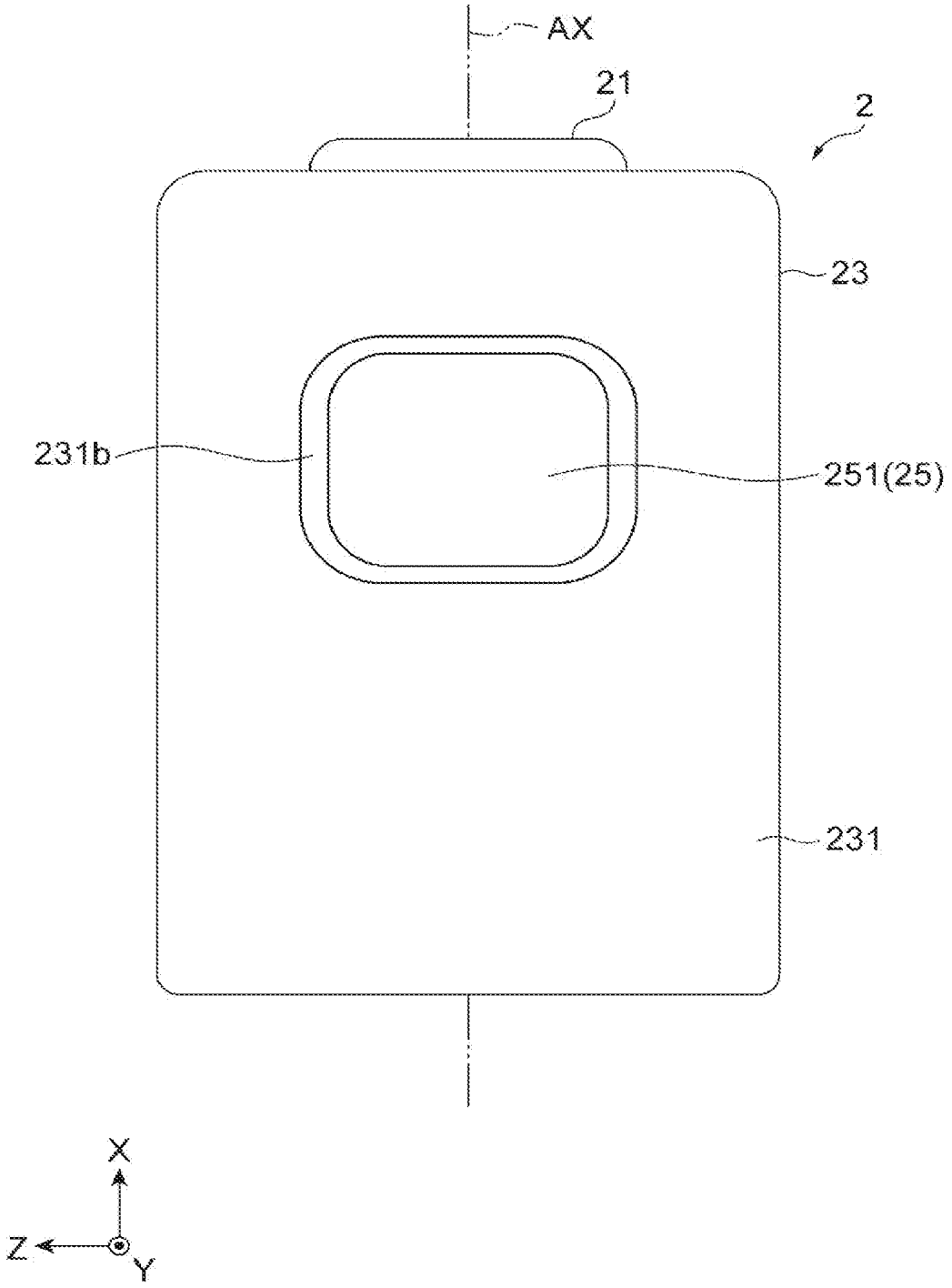
FIG. 8 is a side view of the electron beam generator.

As illustrated in FIG. 8, the use of the two exhaust pumps (vacuum pumps 5*a* and 5*b*) illustrated in FIG. 1 may be replaced with an example structure (X-ray generation apparatus 1A) in which both the internal space S1 and the internal space S2 can be evacuated by means of one exhaust pump (here, the vacuum pump 5*b* as an example). In some examples, the exhaust flow path E1 and the exhaust flow path E2 may be fluidly coupled to each other by means of a communication path E3 located outside the housing 6 and the housing 7. In other examples, the communication path E3 may comprise a through hole continuously provided from the inside of the wall portion of the housing 7 to the inside of the wall portion of the housing 6 so as to fluidly couple the exhaust flow path E1 and the exhaust flow path E2 to each other. Although either the vacuum pump 5*a* or the vacuum pump 5*b* may be used as the single exhaust pump, more efficient evacuation can be performed by the vacuum pump 5*b* fluidly coupled to the exhaust flow path E1 being used as the exhaust pump.

In some examples, a voltage is applied to the electron gun 2 in a state where the internal spaces S1 and S2 and the electron passage P are suctioned by the exhaust system. As a result, the electron beam EB having the circular cross-sectional shape is emitted from the electron gun 2. The electron beam EB is focused on the target 31 and deformed so as to have an elliptical cross-sectional shape by the magnetic lens 4, and the electron beam EB is incident on the rotating target 31. When the electron beam EB is incident on the target 31, the X-ray XR is generated at the target 31 and the X-ray XR having a substantially circular effective focal point shape is emitted outside the housing 7 from the X-ray passage hole 7*a*.

As illustrated in FIG. 2, an example configuration of the cylindrical tube 9 has a shape in which the size of the diameter of the cylindrical tube 9 changes in stages along the X-axis direction. For example, the cylindrical tube 9 has six cylindrical portions 91 to 96 located along the X-axis direction. Each of the cylindrical portions 91 to 96 has a constant diameter along the X-axis direction. In some examples, the outer diameter of the cylindrical tube 9 may not change in synchronization with the inner diameter of the cylindrical tube 9. Accordingly, the outer diameter of the cylindrical tube 9 may be constant.

The cylindrical portion 91 (e.g., a first cylindrical portion) includes a first end portion 9*a* of the cylindrical tube 9, which is on the electron gun 2 side of the cylindrical portion 91. The cylindrical portion 91 extends from the first end portion 9*a* to a second end portion 91*a* surrounded by a portion of the coil 42*a* on the electron gun 2 side of the cylindrical portion 91 at a boundary part 9*c*. A first end portion 92*a* of the cylindrical portion 92 (e.g., a second cylindrical portion) is connected to the second end portion 91*a* of the cylindrical portion 91 on the target 31 side of the cylindrical portion 91. In some examples, the cylindrical portion 92 extends from the second end portion 91*a* of the cylindrical portion 91 to a second end portion 92*b* of the cylindrical portion 92 which is slightly closer to the target 31 than the pole piece 42*b*. For example, the second end portion 92*b* of the cylindrical portion 92 may be located between the pole piece 42*b* and the target 31 along the X-axis direction. Additionally, a first end portion 93*a* of the cylindrical portion 93 (e.g., a third cylindrical portion) is connected to the second end portion 92*b* of the cylindrical portion 92 on the target 31 side of the cylindrical portion 92.

The cylindrical portion 93 extends from the second end portion 92*b* of the cylindrical portion 92 to a second end portion 93*b* of the cylindrical portion 93 which is surrounded by the magnetic quadrupole lens 43. A first end of the cylindrical portion 94 (e.g., a fourth cylindrical portion) is connected to the second end portion 93*b* of the cylindrical portion 93 on the target 31 side of the cylindrical portion 93. The cylindrical portion 94 extends from the second end portion 93*b* of the cylindrical portion 93 to a housing side 7 of the wall portion 44*c*.

The cylindrical portion 95 (e.g., a fifth cylindrical portion) and the cylindrical portion 96 (e.g., a sixth cylindrical portion) pass through an inside of a wall portion 71 of the housing 7. The wall portion 71 is located at a position facing the target 31 and extends so as to intersect with the X-axis direction. The cylindrical portion 95 is connected to a second end of the cylindrical portion 94 on the target 31 side of the cylindrical portion 94. The cylindrical portion 95 extends from the end of the cylindrical portion 94 to an intermediate position in the wall portion 71. The cylindrical portion 96 is connected to the cylindrical portion 95 at the intermediate position in the wall portion 71, on the target 31 side of the cylindrical portion 95. The cylindrical portion 96 extends from the end of the cylindrical portion 95 to a second end portion 9*b* of the cylindrical tube 9 on the target 31 side of the cylindrical tube 9. As illustrated in FIG. 2, the example X-ray passage hole 7*a* is provided in a wall portion 72 connected to the wall portion 71 and extending so as to intersect with the Z-axis direction. The X-ray passage hole 7*a* penetrates the wall portion 72 along the Z-axis direction.

In some examples, a relationship of "d2>d3>d1>d4>d5>d6" is established when the diameters of the six cylindrical portions 91 to 96 are d1 to d6, respectively. As an example, a first diameter d1 is 6 to 12 mm, a second diameter d2 is 10 to 14 mm, a third diameter d3 is 8 to 12 mm, a fourth diameter d4 is 4 to 6 mm, a fifth diameter d5 is 4 to 6 mm, and a sixth diameter d6 is 0.5 to 4 mm.

The cylindrical portion 91 and at least a part of the cylindrical portion 92 are positioned closer to the electron gun 2 than the part of the electron passage P that is surrounded by the pole piece 42*b* of the magnetic focusing lens 42 (gap between the yoke 42*c* and the yoke 42*d* in particular). In some examples, the cylindrical portion 91 and the at least part of the cylindrical portion 92 constitute the "part of the electron passage P that is closer to the electron gun 2 than the part of the electron passage P surrounded by the pole piece 42*b* of the magnetic focusing lens 42" (hereinafter, referred to as the "first cylindrical part"). Further, as described above, the diameter d2 of the cylindrical portion 92 is larger than the diameter d1 of the cylindrical portion 91 (d2>d1). Accordingly, the cylindrical portion 92 is larger in diameter than the cylindrical portion 91 adjacent to the electron gun 2 side. In some examples, at the first cylindrical part, at least a part of the cylindrical portion 92 constitutes a diameter-increased portion that increases in diameter toward the target 31 side of the cylindrical portion 92.

The cylindrical portion 96 includes the end portion 9*b* of the electron passage P on the target 31 side of the electron passage P. Further, the diameter d6 of the cylindrical portion 96 is smaller than the diameter d5 of the cylindrical portion 95 (d6<d5). Accordingly, the cylindrical portion 96 is smaller in diameter than the cylindrical portion 95 adjacent to the electron gun 2 side such that the cylindrical portion 96 constitutes a diameter-reduced portion that decreases in diameter toward the target 31 side of the cylindrical portion 96. In some examples, the diameter d2 of the cylindrical portion 92 is the maximum diameter of the cylindrical tube 9 that sequentially decreases from the cylindrical portion 92 toward the target 31 side of the cylindrical tube 9. Accordingly, the part of the cylindrical tube 9 including the cylindrical portions 93 to 96 can be regarded as constituting the diameter-reduced portion.

In some examples, the size of the electron beam EB is adjusted by the magnetic focusing lens 42 located downstream of the electron gun 2 and the cross-sectional shape of the electron beam EB is deformed into an elliptical shape by the magnetic quadrupole lens 43 located downstream of the magnetic focusing lens 42. Accordingly, the size of the electron beam EB and the cross-sectional shape can be adjusted independently of each other.

Figure 4A:
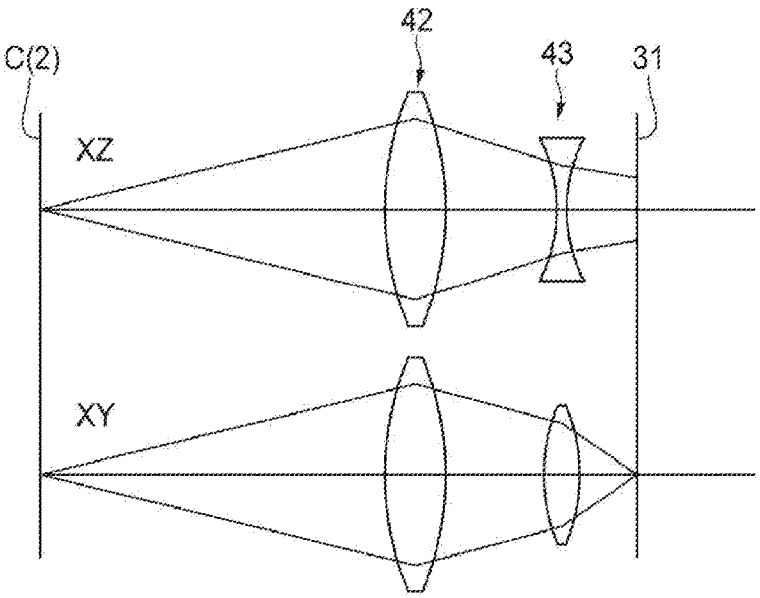
FIG. 4A is a schematic diagram of an example configuration including a magnetic focusing lens and a magnetic quadrupole lens).
Figure 4B:
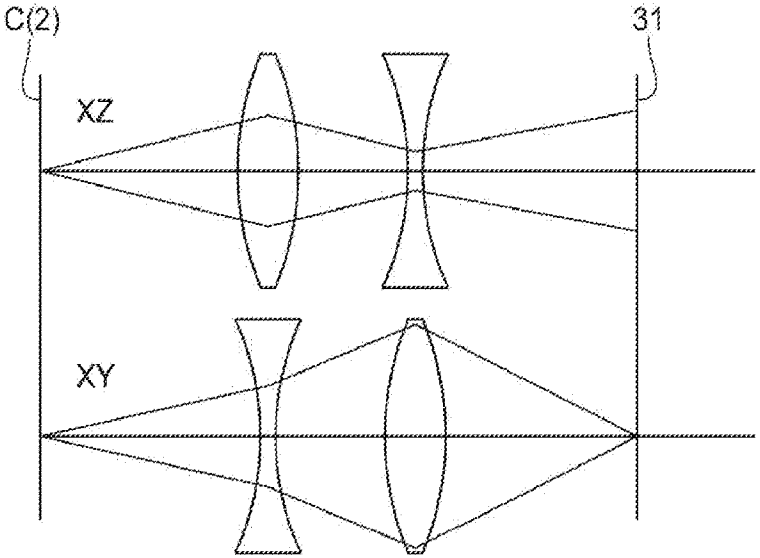
FIG. 4B is a schematic diagram of a configuration of a comparative example (doublet).

FIG. 4A illustrates a schematic diagram of an example configuration including the magnetic focusing lens 42 and the magnetic quadrupole lens 43 illustrated in FIGS. 1 and 2. FIG. 4B is a schematic diagram of a configuration of a comparative example (doublet). FIGS. 4A and 4B are diagrams schematically illustrating an example optical system acting on the electron beam EB between the cathode C (electron gun 2) and the target 31. As illustrated in the configuration of the comparative example at FIG. 4B, the aspect ratio and the size of the cross-sectional shape of the electron beam are adjusted by the combination of a two-stage magnetic quadrupole lens in which surfaces acting as concave and convex lenses are replaced with each other. In the comparative example of FIG. 4B, the lens that determines the size of the cross-sectional shape of the electron beam and the lens that determines the aspect ratio are not independent of each other. Accordingly, the size and the aspect ratio are simultaneously adjusted by combining the two-stage magnetic quadrupole lens, which can complicate the focal dimension adjustment and focal shape adjustment. In the example configuration illustrated in FIG. 4A, in contrast, the size of the cross-sectional shape of the electron beam EB is adjusted by the upstream magnetic focusing lens 42. Accordingly, the cross-sectional shape of the electron beam EB is reduced to a certain size by the magnetic focusing lens 42. Subsequently, the aspect ratio of the cross-sectional shape of the electron beam EB is adjusted by the downstream magnetic quadrupole lens 43. In the example configuration of FIG. 4A, the lens (magnetic focusing lens 42) that determines the size of the cross-sectional shape of the electron beam EB and the lens (magnetic quadrupole lens 43) that determines the aspect ratio are independent of each other in this manner. Accordingly, a focal dimension adjustment and focal shape adjustment may be readily and flexibly performed.

Further, although the electron beam EB passing through the magnetic focusing lens 42 rotates around an axis along the X-axis direction, the cross-sectional shape of the electron beam reaching the magnetic quadrupole lens 43 through the magnetic focusing lens 42 is constant (circular) regardless of the rotation amount of the electron beam EB in the magnetic focusing lens 42 since the cross-sectional shape of the electron beam EB emitted by the electron gun 2 is circular. As a result, a cross-sectional shape F1 of the electron beam EB (cross-sectional shape along the YZ plane) in the magnetic quadrupole lens 43 can therefore be consistently and reliably formed into an elliptical shape having a major axis X1 along the Z direction and a minor axis X2 along the Y-axis direction. As a result, the size and the aspect ratio of the cross-sectional shape of the electron beam EB may be readily and flexibly adjusted.

The performance of the example X-ray generation apparatus 1 provided with the electron gun 2 and magnetic lens 4 was evaluated by conducting an experiment. During the experiment, a high voltage was applied to the electron gun 2 and the target 31 was set to the ground potential. The X-ray XR having an effective focal point dimension of "40 μm×40 μm" was obtained at a preselected output (voltage applied to the cathode C). In the case of a change in focal dimension during a 1,000-hour operation, the effective focal point dimension was readily obtained again by the electric current amount of the coil 43*d* of the magnetic quadrupole lens 43 being adjusted without a change in the operating condition on the cathode C side. In this manner, it has been confirmed that the effective focal point dimension of the X-ray XR may be readily corrected in accordance with a dynamic change by performing an adjustment of the electric current amount of the coil 43*d* with the X-ray generation apparatus 1.

Figure 5:
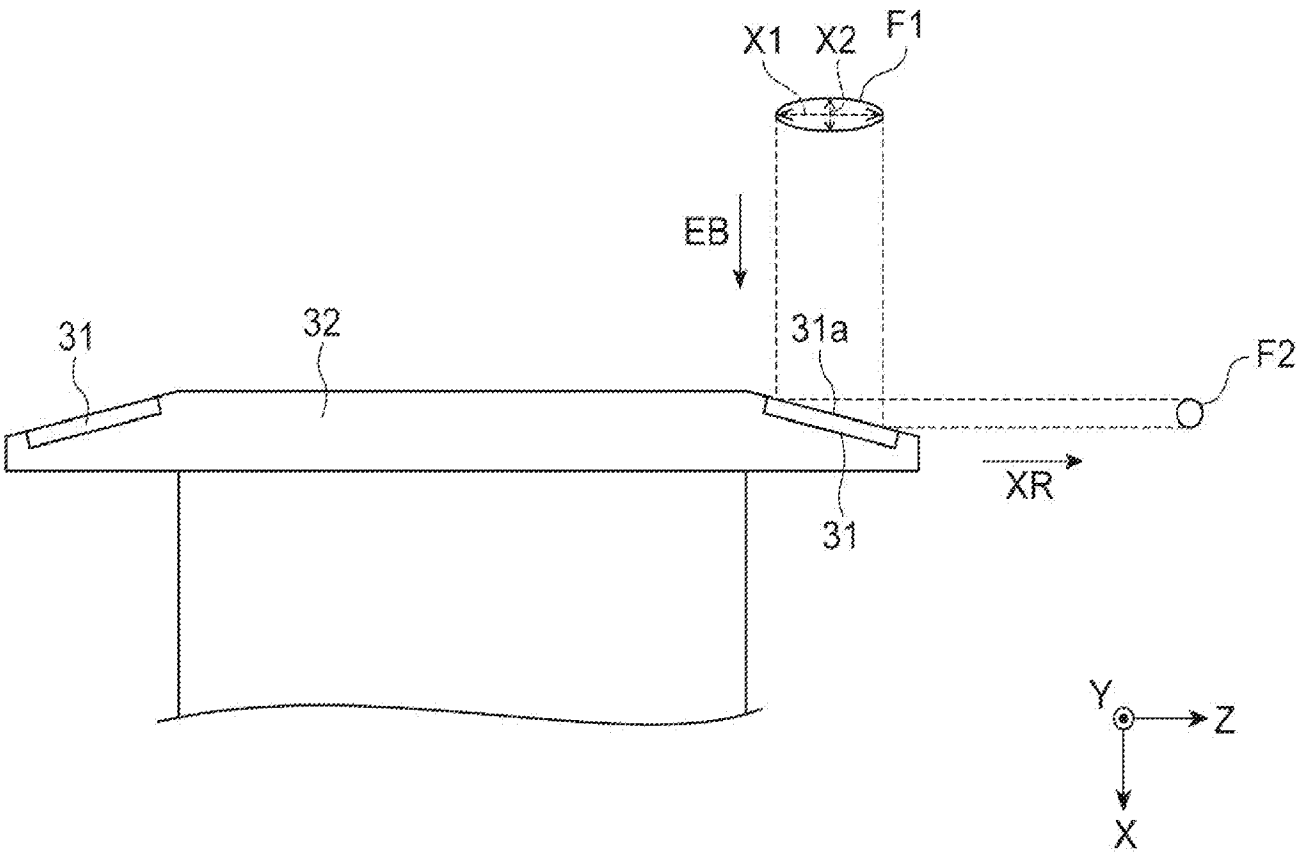
FIG. 5 is a diagram illustrating an example relationship between a cross-sectional shape of an electron beam and the shape of an effective focal point of an X-ray.
Figure 6:
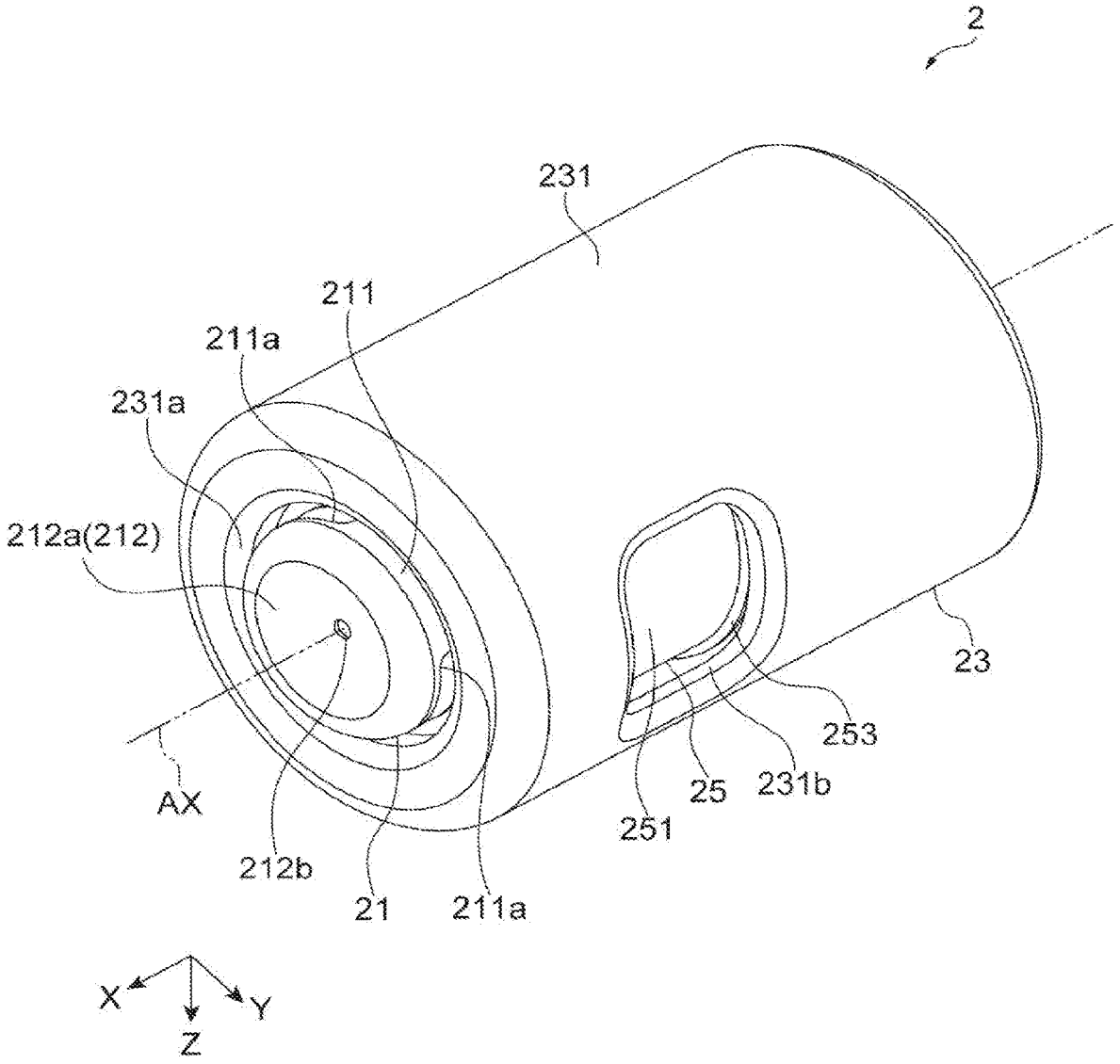
FIG. 6 is a perspective view of an example electron beam generator, such as an electron gun.
Figure 7:
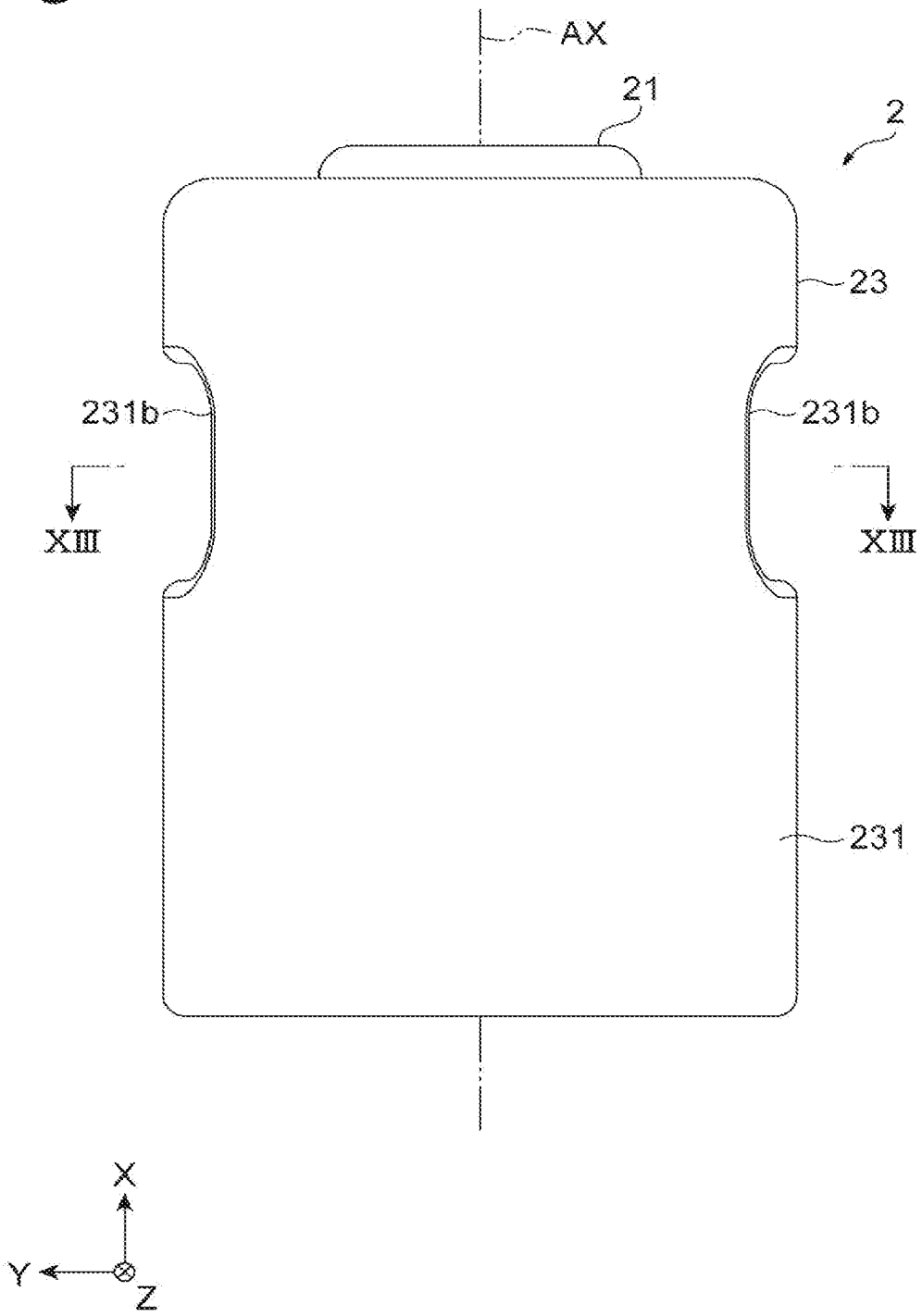
FIG. 7 is a side view of the electron beam generator.

In some examples, as illustrated in FIG. 5, the target 31 has an electron incident surface 31*a* on which the electron beam EB is incident. The electron incident surface 31*a* is inclined with respect to the X-axis direction and the Z-axis direction. Further, the cross-sectional shape F1 (that is, the ratio between the major axis X1 and the minor axis X2) of the electron beam EB subsequent to the deformation into the elliptical shape by the magnetic quadrupole lens 43 and the inclination angle of the electron incident surface 31*a* with respect to the X-axis direction and the Y-axis direction are adjusted such that a focal shape F2 of the X-ray XR viewed from the extraction direction of the X-ray XR (Z-axis direction) is substantially circular. In some examples, the shape of the focal point (effective focal point) of the extracted X-ray XR can be made substantially circular by adjusting the forming condition of the magnetic quadrupole lens 43 (aspect ratio) and the inclination angle of the electron incident surface 31*a* of the target 31. As a result, an inspection image may be obtained during, for example, an X-ray inspection using the X-ray XR generated by the X-ray generation apparatus 1.

In some examples, as illustrated in FIG. 2, the length of the magnetic focusing lens 42 along the X-axis direction exceeds the length of the magnetic quadrupole lens 43 along the X-axis direction. Here, "length of the magnetic focusing lens 42 along the X-axis direction" means the total length of the yoke 42*c* surrounding the coil 42*a*. In some examples, the number of turns of the coil 42*a* of the magnetic focusing lens 42 is easily ensured. As a result, the electron beam EB may be focused by generating a relatively large magnetic field in the magnetic focusing lens 42, in order to achieve an increase in reduction ratio. Further, the distance from the electron gun 2 to the center of the lens constituted by the magnetic focusing lens 42 (part where the pole piece 42*b* is provided) may be increased in order to reduce the size of the electron beam EB incident on the electron incident surface 31*a* of the target 31.

Further, the inner diameter D of the pole piece 42*b* of the magnetic focusing lens 42 exceeds the inner diameter d of the magnetic quadrupole lens 43 (see FIG. 3). In some examples, the spherical aberration of the lens constituted by the magnetic focusing lens 42 may be reduced by making the inner diameter D of the pole piece 42*b* of the magnetic focusing lens 42 relatively large. In addition, the number of turns of the coil 43*d* in the magnetic quadrupole lens 43 may be reduced, and the amount of electric current flowing through the coil 43*d* may be reduced, by making the inner diameter d of the magnetic quadrupole lens 43 relatively small. As a result, the amount of heat generation in the magnetic quadrupole lens 43 can be reduced.

Further, the X-ray generation apparatus 1 is provided with the cylindrical tube 9 extending along the X-axis direction and forming the electron passage P through which the electron beam EB passes. Further, the magnetic focusing lens 42 and the magnetic quadrupole lens 43 are directly or indirectly connected to the cylindrical tube 9. In some examples, the magnetic focusing lens 42 and the magnetic quadrupole lens 43 can be disposed or attached with respect to the cylindrical tube 9 as a reference, and thus the central axes of the magnetic focusing lens 42 and the magnetic quadrupole lens 43 can be coaxially disposed with high precision. As a result, a possible distortion of the profile (cross-sectional shape) of the electron beam EB may be prevented subsequent to passage through the magnetic focusing lens 42 and the magnetic quadrupole lens 43.

Further, the X-ray generation apparatus 1 is provided with the deflection coil 41. In some examples, the angular deviation generated between the emission axis of the electron beam EB emitted from the electron gun 2 and the central axis of the magnetic focusing lens 42 and the magnetic quadrupole lens 43 may be corrected. In addition, the deflection coil 41 is located between the electron gun 2 and the magnetic focusing lens 42. In some examples, the traveling direction of the electron beam EB may be adjusted before the electron beam EB passes through the magnetic focusing lens 42 and the magnetic quadrupole lens 43. As a result, the cross-sectional shape of the electron beam EB incident on the target 31 may be maintained in an intended elliptical shape.

The electron passage P that extends between the housing 6 accommodating the cathode C (electron gun 2) and the housing 7 accommodating the target 31 is formed in the X-ray generation apparatus 1. Further, the part including the end portion of the electron passage P on the target 31 side (end portion 9*b* of the cylindrical tube 9) is reduced in diameter toward the target 31 side of the cylindrical tube 9. In some examples, the cylindrical portion 96 (or the cylindrical portions 93 to 96) constitutes the diameter-reduced portion decreasing in diameter toward the target 31 side of the cylindrical portion 96. As a result, fewer reflected electrons which result from the electron beam EB being incident on the target 31 in the housing 7 may reach the inside of the housing 6 via the electron passage P. Accordingly, a deterioration of the cathode C attributable to the electrons reflected from the target 31 may be suppressed or prevented. The reflected electrons are electrons of the electron beam EB incident on the target 31 that are reflected without being absorbed by the target 31.

Gas may be generated by the electron gun 2 when the electron beam EB is emitted by the cathode C. The gas may remain in a space in which the cathode C is accommodated. Additionally, gas (e.g., gas byproducts, such as $H_2$, $H_2O$, $N_2$, CO, $CO_2$, $CH_4$, Ar) may be generated in the housing 7 due to a collision of the electron beam EB with the target 31, which may also result in electrons being reflected from the surface of the target 31. In some examples, the inlet of the electron passage P on the target 31 side of the cylindrical tube 9 (that is, the end portion 9*b*) is narrow, and thus less gas is suctioned into the housing 6 side (that is, the internal space S1) via the electron passage P and less gas is discharged from the exhaust flow path E1 provided in the housing 6. Accordingly, the housing 7 itself is provided with a discharge path for the gas (the exhaust flow path E2) in the X-ray generation apparatus 1. As a result, a deterioration of the cathode C attributable to the reflected electrons may be suppressed or prevented while appropriately evacuating each of the housings 6 and 7.

Further, the part of the magnetic focusing lens 42 (first cylindrical part) that is closer to the electron gun 2 side than the part of the electron passage P surrounded by the pole piece 42*b* has the diameter-increased portion (at least a part of the cylindrical portion 92) increasing in diameter toward the target 31 side of the cylindrical portion 92. In some examples, a movement of the reflected electrons to the cathode C side via the electron passage P may be suppressed by means of the diameter-increased portion increasing in diameter toward the target 31 side of the cylindrical portion 92 (that is, the part decreasing in diameter toward the cathode C side) even when the reflected electrons have entered the electron passage P from the end portion 9*b* of the electron passage P on the target 31 side. In addition, it is possible to effectively suppress a collision between the electron beam EB heading for the target 31 and the inner wall of the electron passage P (inner surface of the cylindrical tube 9).

Further, from the electron gun 2 side of the cylindrical tube 9 toward the target 31 side of the cylindrical tube 9, the diameter-increased portion includes a part (that is, the boundary part between the cylindrical portion 91 and the cylindrical portion 92) discontinuously changing from a part (that is, the cylindrical portion 91) having the diameter d1 (first diameter) to a part (that is, the cylindrical portion 92) having the diameter d2 (second diameter) larger than the diameter d1. In some examples, the diameter of the cylindrical tube 9 changes in a stepped manner at the boundary part between the cylindrical portion 91 and the cylindrical portion 92. The boundary part 9*c* may be formed by an annular wall having the diameter d1 as an inner diameter and the diameter d2 as an outer diameter is formed (see FIG. 2). In some examples, the reflected electrons may be caused to collide with the boundary part 9*c* even when the reflected electrons traveling from the target 31 side to the electron gun 2 side through the electron passage P are present. As a result, a movement of the reflected electrons to the cathode C side can be more effectively suppressed or prevented.

Further, the diameter of the part of the electron passage P that is surrounded by the pole piece 42*b* of the magnetic focusing lens 42 (diameter d2 of the cylindrical portion 92) is equal to or larger than the diameter of the other part of the electron passage P. Accordingly, the diameter of the electron passage P is maximized at the part surrounded by the pole piece 42*b* of the magnetic focusing lens 42. In some examples, a collision between the electron beam EB heading for the target 31 and the inner wall of the electron passage P (inner surface of the cylindrical tube 9) can be effectively suppressed by the diameter of the part where an increase in the spread of the electron beam EB emitted from the electron gun 2 occurs (that is, the part surrounded by the pole piece 42*b*) being equal to or larger than the diameter of the other part.

Further, the exhaust flow path E1 and the exhaust flow path E2 communicate (e.g., are fluidly coupled) with each other. Additionally, the exhaust unit 5 evacuates the housing 6 via the exhaust flow path E1 and evacuates the housing 7 via the exhaust flow path E2. In some examples, both the internal space S1 in the housing 6 and the internal space S2 in the housing 7 can be evacuated by the common exhaust unit 5, and thus the X-ray generation apparatus 1 can be reduced in size.

Electron Beam Generator Next, the electron gun 2 as an example of electron beam generator will be described with reference to FIGS. 6 to 13. As illustrated in FIGS. 6 to 13, the electron gun 2 has the cathode C, a first grid electrode 21 (a first electrode), a first holding electrode 22, a second grid electrode 23 (a second electrode), a second holding electrode 24, a third holding electrode 25 (a third electrode), and a stem 26. One or both of the first grid electrode 21 and the second grid electrode 23 may be configured to control the amount of the electron beam EB emitted from the cathode C.

Figure 9:
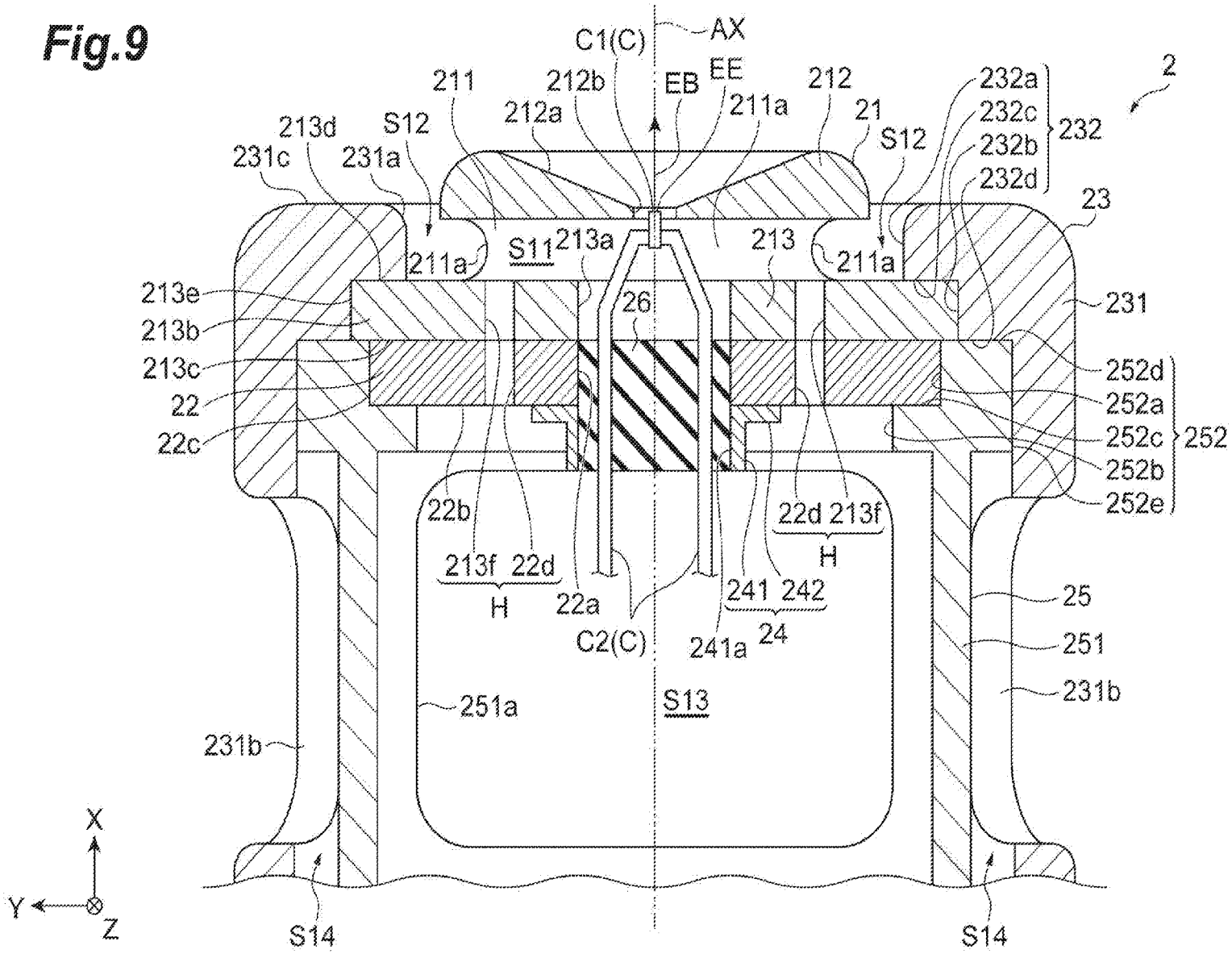
FIG. 9 is a partial cross-sectional view of the electron beam generator.

As illustrated in FIG. 9, the cathode C has a distal end portion C1 and a pair of support pins C2 (support portions). The distal end portion C1 has an electron emission surface EE configured to emit the electron beam EB. The pair of support pins C2 are electrically connected to the distal end portion C1 and support the distal end portion C1. The pair of support pins C2 may be made of a conductive material such as a metal. Additionally, the distal end portion C1 may be formed in a columnar shape. In some examples, the electron emission surface EE, which is the distal end surface of the distal end portion C1, is formed in a circular plane shape. The electron beam EB is emitted along the X-axis direction from the electron emission surface EE of the distal end portion C1. An emission axis AX of the electron beam EB is parallel to the X-axis direction and passes through the center of the electron emission surface EE of the distal end portion C1. In some examples, the emission axis AX is also the central axis of the electron beam generator 2. The pair of support pins C2 are held by the stem 26 made of an insulating member such as ceramic. The end portion of the support pin C2 that is on the side of the cathode C opposite to the distal end portion C1 is electrically connected to an external electric power supply device via, for example, a connection member disposed in a space S13 surrounded by the third holding electrode 25.

Figure 10:
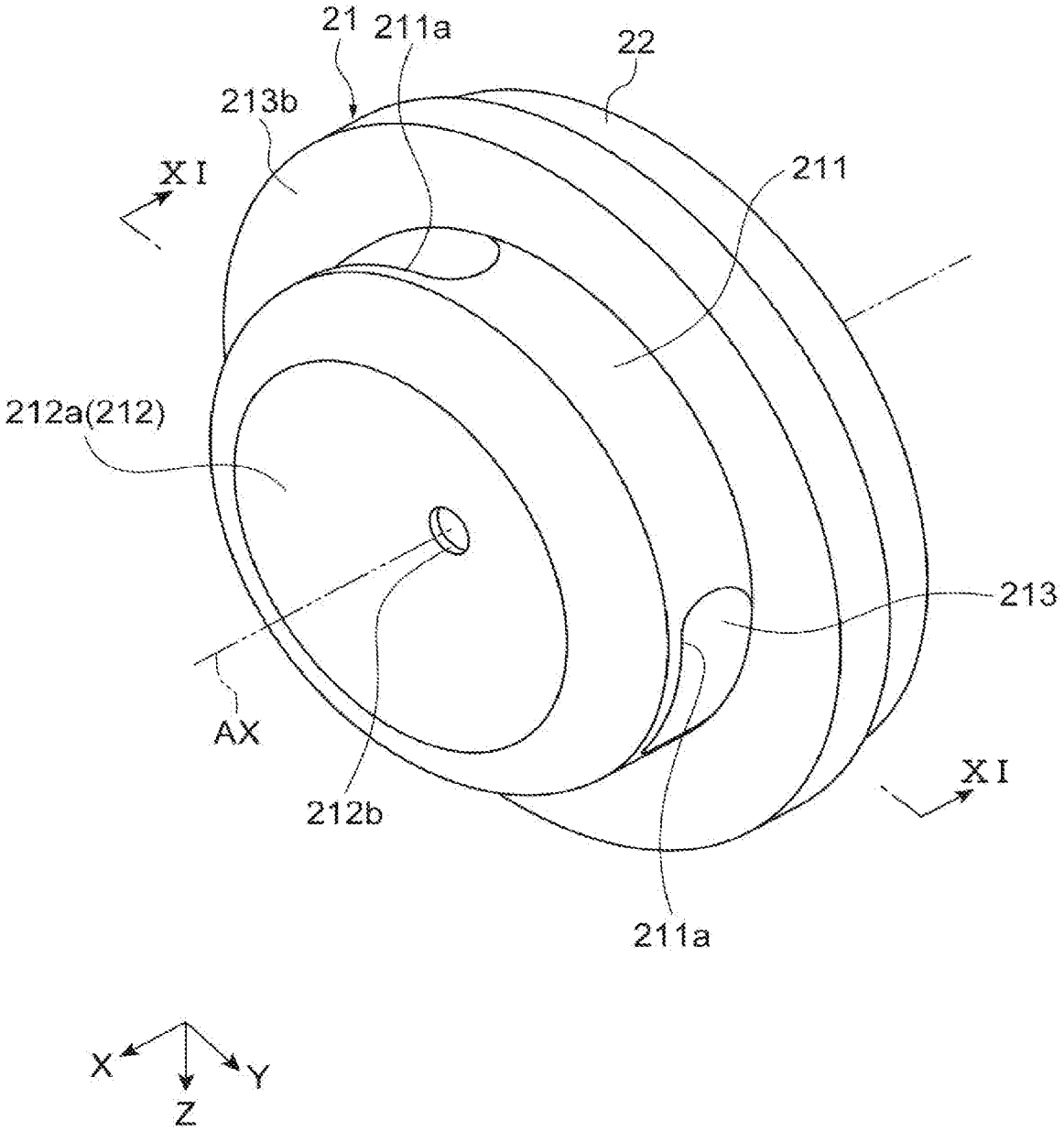
FIG. 10 is a perspective view of a first grid electrode and a first holding electrode.
Figure 11:
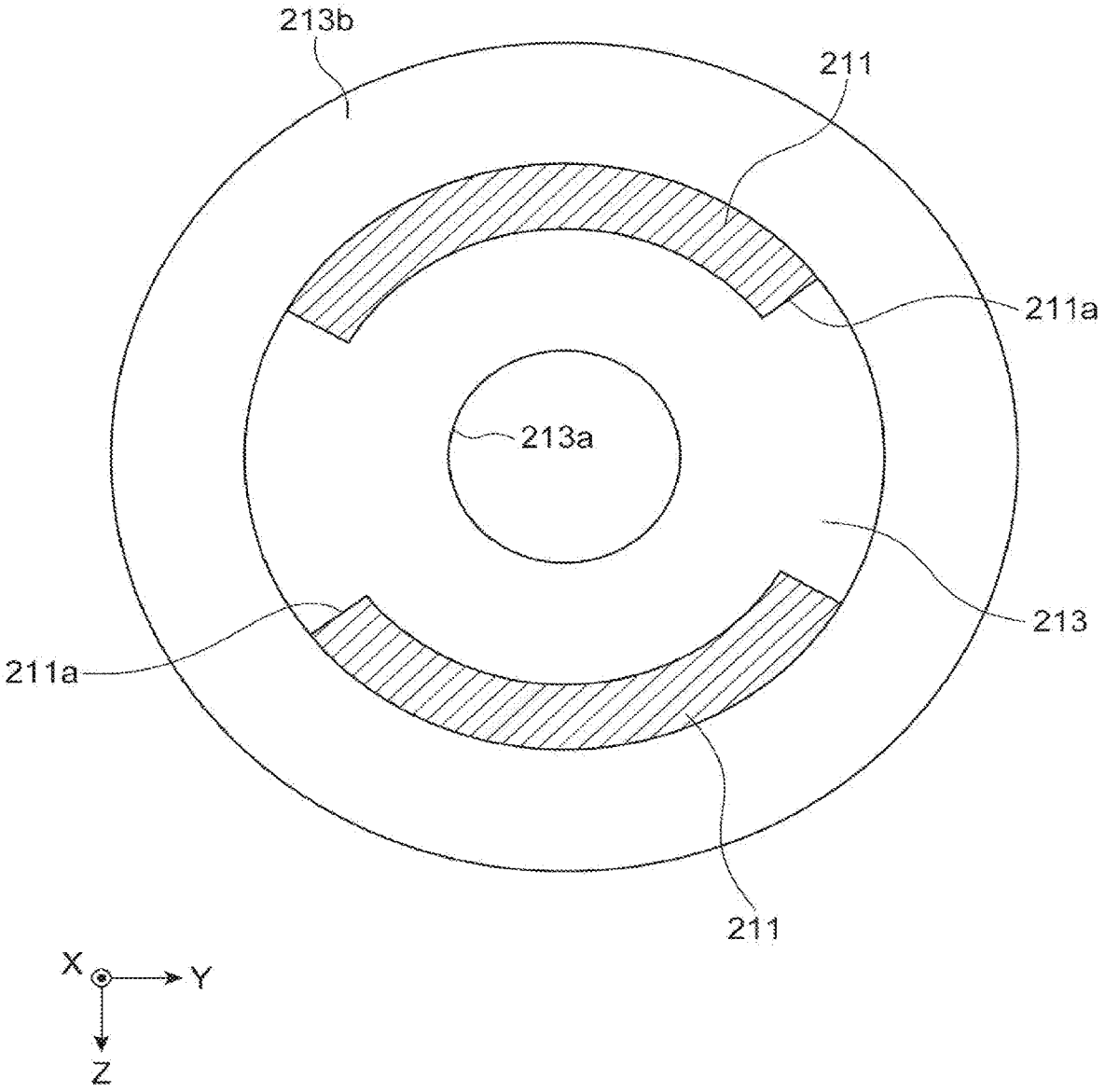
FIG. 11 is a cross-sectional view taken along line XI-XI in FIG. 10.

As illustrated in FIGS. 9 to 11, the first grid electrode 21 accommodates the distal end portion C1 of the cathode C (the distal end portion C1 and at least part of the pair of support pins C2 on the distal end portion C1 side of the cathode C). The first grid electrode 21 has a side wall 211 (first side wall), a top wall 212, and a bottom wall 213. The material of the first grid electrode 21 may comprise a metal material having a high melting point (such as titanium, molybdenum, or an alloy containing at least one of titanium and molybdenum).

The side wall 211 surrounds the distal end portion C1 of the cathode C around the emission axis AX. In some examples, the side wall 211 is formed in a cylindrical shape having the emission axis AX as a central axis. The side wall 211 is provided with an opening portion 211*a* (first opening portion). Additionally, a plurality of (two as an example) the opening portions 211*a* are provided in the side wall 211 at equal intervals along the circumferential direction around the emission axis AX. In some examples, two opening portions 211*a* are provided so as to face each other across the emission axis AX. Accordingly, the two opening portions 211*a* may face each other in the Y-axis direction. Each opening portion 211*a* has a substantially rectangular long hole shape extending along the circumferential direction around the emission axis AX. Each opening portion 211*a* has a corner portion having a curved shape (R shape). A space S11 (first space) surrounded by the side wall 211 communicates with a space S12 (space between the side wall 211 and a side wall 231 of the second grid electrode 23), which will be described in additional detail later, via the opening portion 211*a*. The space S11 is surrounded by the side wall 211, the top wall 212, and the bottom wall 213. In some examples, the space S11 accommodates the distal end portion C1 of the cathode C.

The top wall 212 is connected to the end portion of the side wall 211 that is on the target 31 side (electron emission direction side). The top wall 212 extends along the plane orthogonal to the emission axis AX (YZ plane) so as to cover the cathode C. A surface 212*a* of the top wall 212 on the target 31 side (electron emission direction side) is inclined in a tapered shape so as to approach the target 31 side as the distance from the emission axis AX to the surface 212*a* increases. A circular opening portion 212*b* penetrating the surface 212*a* along the X-axis direction is provided in the middle portion of the surface 212*a*. Accordingly, the surface 212*a* constitutes a surface inclined in a cone shape toward the opening portion 212*b*. The center of the opening portion 212*b* is positioned on the emission axis AX. The electron beam EB emitted from the electron emission surface EE of the distal end portion C1 of the cathode C passes through the opening portion 212*b*. At least the electron emission surface EE of the distal end portion C1 is disposed inside the opening portion 212*b*. In some examples, the distal end portion C1 does not protrude to the target 31 side (electron emission direction side) beyond the opening portion 212*b*. Accordingly, the electron emission surface EE does not protrude from the opening portion 212*b*.

The bottom wall 213 is connected to the end portion of the side wall 211 that is on the side opposite to the end portion on the target 31 side (electron emission direction side). The bottom wall 213 extends along the plane orthogonal to the emission axis AX (YZ plane). The pair of support pins C2 pass through a circular opening portion 213*a* that penetrates the bottom wall 213 along the X-axis direction and that is provided in the middle portion of the bottom wall 213. The center of the opening portion 213*a* is positioned on the emission axis AX. The inner diameter of the opening portion 213*a* is larger than the inner diameter of the opening portion 212*b*. The bottom wall 213 has a flange portion 213*b*. The flange portion 213*b* is annular-shaped and extends outside the side wall 211 when viewed from a direction along the emission axis AX (X-axis direction).

The first holding electrode 22 is a disk-shaped electrode connected to the first grid electrode 21. The material of the first holding electrode 22 is a metal material having a high melting point (such as titanium, molybdenum, or an alloy containing at least one of titanium and molybdenum). The first holding electrode 22 is disposed on the side of the first grid electrode 21 that is opposite to the side (electron emission direction side) of the first grid electrode 21 where the target 31 is positioned. For example, the first holding electrode 22 is disposed along a surface 213*c* of the bottom wall 213 on the side opposite to the target 31 side (electron emission direction side) so as to be in contact with the surface 213*c*. An opening portion 22*a* (central opening portion) penetrating the first holding electrode 22 in the X-axis direction is provided in the middle portion of the first holding electrode 22. The center of the opening portion 22*a* is positioned on the emission axis AX. Further, the bottom wall 213 and the first holding electrode 22 are provided with a circular through hole H extending along the X-axis direction and allowing the space S11 and the space S13 (described later) to communicate with and/or be fluidly coupled to each other. In some examples, a plurality of (two as an example) the through holes H are provided at equal intervals along the circumferential direction around the emission axis AX. Additionally, two through holes H are provided so as to face each other across the emission axis AX. Accordingly, the two through holes H are provided so as to face each other in the Y-axis direction. A through hole 213*f* provided in the bottom wall 213 and a through hole 22*d* provided coaxially with the through hole 213*f* in the first holding electrode 22 constitute the through hole H. In some examples, the through hole H allowing the space S11 and the space S13 to communicate with and/or be fluidly coupled to each other is formed by the through hole 213*f* and the through hole 22*d* which overlap each other when viewed from the X-axis direction. When viewed from the X-axis direction, the outer edge of the first holding electrode 22 is positioned inside the outer edge of the flange portion 213*b*.

The stem 26 is a disk-shaped member fixing the cathode C to the stem 26. The stem 26 is provided with an insertion hole through which the pair of support pins C2 serving as an electric power supply path is inserted. The stem 26 is made of an insulating material. The material of the stem 26 is, for example, alumina ($Al_2O_3$). The stem 26 is disposed in the opening portion 22*a*. The part of the stem 26 that protrudes from the opening portion 22*a* is held by the second holding electrode 24 (described in further detail later).

The second holding electrode 24 is disposed on the side of the first holding electrode 22 that is opposite to the side (electron emission direction side) of the first holding electrode 22 where the target 31 is positioned. For example, the second holding electrode 24 is disposed along a surface 22*b* of the first holding electrode 22 on the side opposite to the target 31 side (electron emission direction side) so as to be in contact with the surface 22*b*. The material of the second holding electrode 24 is a metal material having a high melting point (such as an alloy of copper and molybdenum or an alloy of copper and tungsten). The second holding electrode 24 has a side wall 241 and a flange portion 242. The side wall 241 is formed in a cylindrical shape having the emission axis AX as a central axis. The flange portion 242 is annular shaped and connected to the end portion of the side wall 241 that is on the target side (electron emission direction side) and extending outside the side wall 241 along the plane orthogonal to the emission axis AX (YZ plane). The flange portion 242 is disposed along the surface 22*b* of the first holding electrode 22 so as to be in contact with the surface 22*b*. When viewed from the X-axis direction, the outer edge of the flange portion 242 is positioned inside the outer edge of the first holding electrode 22. In some examples, the outer edge of the flange portion 242 is positioned inside the edge portion of the through hole H on the emission axis AX side such that the flange portion 242 does not block the through hole H. An inner surface 241*a* of the side wall 241 is continuous with the opening portion 22*a* of the first holding electrode 22. Accordingly, the inner diameter of the side wall 241 matches the inner diameter of the opening portion 22*a*. The stem 26 is accommodated inside the opening portion 22*a* and the side wall 241. In some examples, the stem 26 is inserted into the opening portion 22*a* of the first holding electrode 22. In addition, the outer surface of the part of the stem 26 that protrudes from the opening portion 22*a* and the inner surface 241*a* of the side wall 241 of the second holding electrode 24 are joined to each other, and the surface 22*b* of the first holding electrode 22 and the flange portion 242 are joined to each other. Accordingly, the stem 26 may be selectively positioned and fixed in the electron gun 2.

Figure 12:
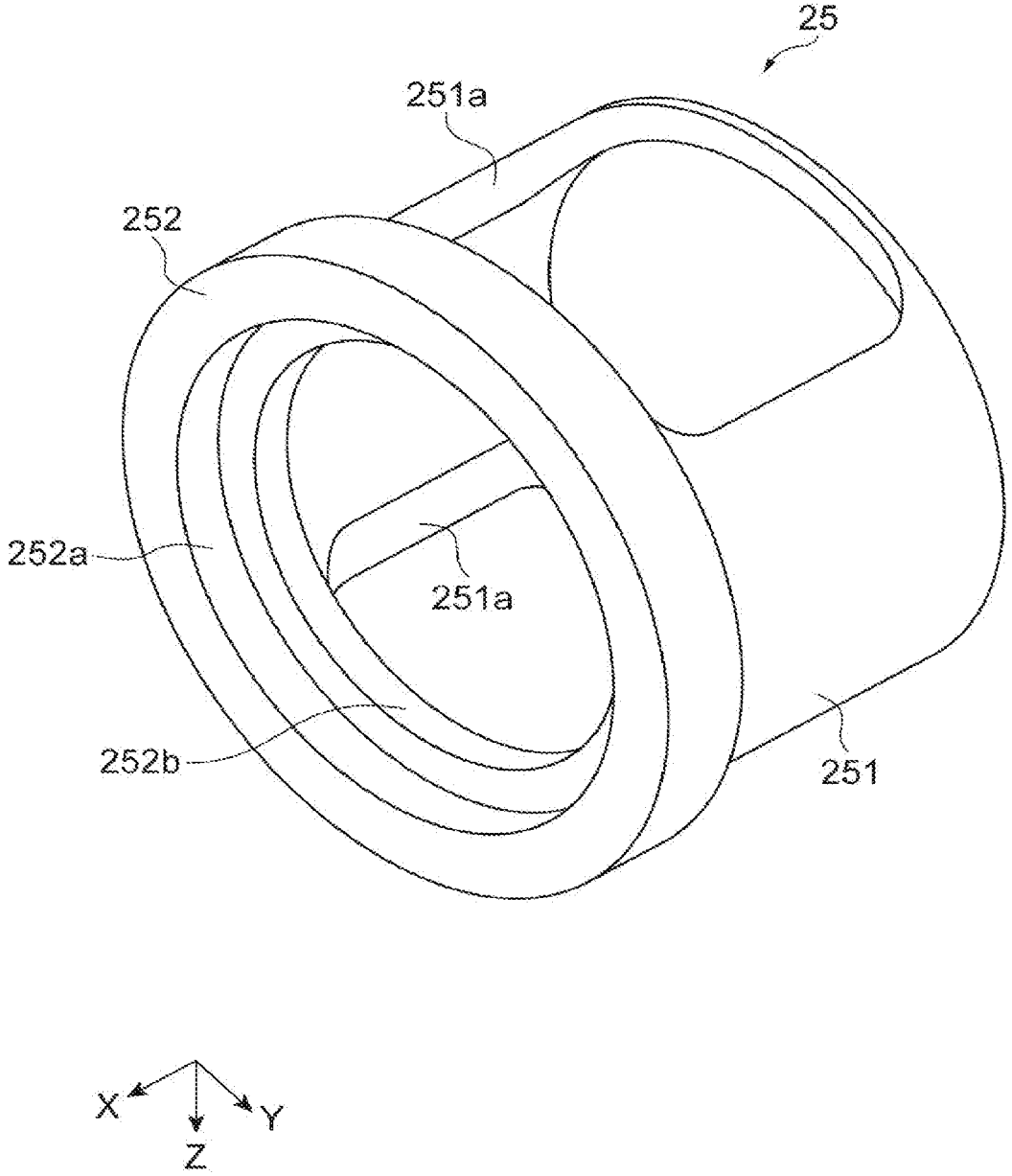
FIG. 12 is a perspective view of a second holding electrode.

As illustrated in FIGS. 9 and 12, the third holding electrode 25 surrounds at least part of the cathode C (for example, a part of the pair of support pins C2). The third holding electrode 25 has a side wall 251 (third side wall) and a holding portion 252.

The side wall 251 is formed in a cylindrical shape having the emission axis AX as a central axis. The side wall 251 is provided with an opening portion 251*a* (third opening portion). In some examples, a plurality of (two as an example) the opening portions 251*a* are provided in the side wall 251. The two opening portions 251*a* face each other in a direction orthogonal to the emission axis AX (such as the Z-axis direction). Each opening portion 251*a* has a corner portion formed in a substantially rectangular shape having a curved shape (R shape). The length of the side of each opening portion 251*a* in a direction along the emission axis AX is substantially equal to the length of the side wall 251 in the direction along the emission axis AX. The space S13 (third space) surrounded by the side wall 251 and a space outside the side wall 251 (space S14 to be described later) communicate with and/or be fluidly coupled to each other via the opening portion 251*a*.

The holding portion 252 is annular-shaped and connected to the end portion of the side wall 251 on the target 31 side (electron emission direction side). The holding portion 252 holds the first holding electrode 22. Additionally, the holding portion 252 has a part 252*a* (first part) on the target 31 side (electron emission direction side) and a part 252*b* (second part) on the side opposite to the target 31 side. The inner diameter of the part 252*a* substantially matches the outer diameter of the first holding electrode 22. The inner diameter of the part 252*b* is smaller than the inner diameter of the part 252*a*, is larger than the outer diameter of the flange portion 242 of the second holding electrode 24, and is a size at which the through hole H is not blocked. In some examples, the inner surface of the part 252*b* is positioned outside the edge portion of the through hole H that is on the side opposite to the emission axis AX side. A side surface 22*c* of the first holding electrode 22 along the X-axis direction abuts against the inner surface of the part 252*a*. The outer edge part of the surface 22*b* of the first holding electrode 22 abuts against a surface 252*c* of the part 252*b* on the target 31 side (electron emission direction side). Accordingly, the outer edge part of the surface 22*b* of the first holding electrode 22 is placed on the surface 252*c* of the part 252*b*.

As illustrated in FIGS. 6 to 9, the second grid electrode 23 accommodates the cathode C, the first grid electrode 21, the first holding electrode 22, the second holding electrode 24, the third holding electrode 25, and the stem 26. The second grid electrode 23 is formed in a cylindrical shape having the emission axis AX as a central axis. In some examples, the second grid electrode 23 has the side wall 231 (second side wall) formed in a cylindrical shape having the emission axis AX as a central axis. The end portion of the side wall 231 on the target 31 side (electron emission direction side) has a curved shape (R shape).

The side wall 231 includes a cap-shaped surrounding portion 232 surrounding (accommodating) the flange portion 213*b* of the first grid electrode 21 and the holding portion 252 of the third holding electrode 25. The surrounding portion 232 includes the end portion of the side wall 231 on the target 31 side (electron emission direction side). The surrounding portion 232 has a part 232*a* (first part) on the target 31 side (electron emission direction side) and a part 232*b* (second part) on the side opposite to the target 31 side. The surrounding portion 232 is thicker than the other portions of the side wall 231 (such as the part provided with an opening portion 231*b*, as described in further detail later). The thickness of the part 232*a* is larger than the thickness of the part 232*b*. In some examples, the side wall 231 is configured to have a thickness that increases in stages (in a stepwise manner) toward the target 31 side at the part (surrounding portion 232) including the end portion on the target 31 side (electron emission direction side). The inner diameter of the side wall 231 at the part 232*a* is larger than the outer diameter of the side wall 211 of the first grid electrode 21 and smaller than the outer diameter of the flange portion 213*b* of the first grid electrode 21. In addition, the inner diameter of the side wall 231 at the other part where the opening portion 231*b* is provided matches the outer diameter of the holding portion 252 of the third holding electrode 25.

The flange portion 213*b* is fixed by the part 232*a* and the part 232*b* of the surrounding portion 232. For example, a surface 213*d* of the flange portion 213*b* on the target 31 side (electron emission direction side) is fixed by abutting against a surface 232*c* of the part 232*a* on the side opposite to the target 31 side. In addition, a side surface 213*e* of the flange portion 213*b* along the X-axis direction is surrounded by the inner surface of the part 232*b*.

The holding portion 252 is surrounded by the part 232*b* of the surrounding portion 232 and the other part of the side wall 231 that is provided with the opening portion 231*b*. For example, a surface 252*d* of the holding portion 252 on the target 31 side (electron emission direction side) abuts against a surface 232*d* of the part 232*b* on the side opposite to the target 31 side. In addition, a side surface 252*e* outside the holding portion 252 along the X-axis direction is surrounded by the inner surface of the other part of the side wall 231.

The side wall 211 of the first grid electrode 21 and the side wall 231 of the second grid electrode 23 (part 232*a* of the surrounding portion 232) that face each other are separated from each other by a space S12 (second space). In some examples, the space S12 is an annular gap that is formed between the side wall 211 and the part 232*a*. In addition, an opening portion 231*a* (second opening portion) that opens in the X-axis direction is provided in the end portion of the side wall 231 on the target 31 side (that is, an end portion of the part 232*a*) such that the space S12 and the external space of the electron gun 2 (e.g. the internal space S1 of the housing 6) communicate with and/or are fluidly coupled to each other. The end portion of the opening portion 231*a* that is on the target 31 side (electron emission direction side) has a curved shape (R shape).

The side wall 231 is provided so as to cover and hide the opening portion 211*a* of the first grid electrode 21 when viewed from a direction orthogonal to the X-axis direction (direction along the YZ plane). As illustrated in FIG. 9, an end surface 231*c* of the side wall 231 on the target 31 side (electron emission direction side) is positioned closer to the target 31 side than the edge portion of the opening portion 211*a* on the target 31 side. Accordingly, when the electron gun 2 is viewed from a direction perpendicular to the emission axis AX (for example, the Y-axis direction or the Z-axis direction), the opening portion 211*a* covered by the second grid electrode 23 is not visible, although at least a part of the top wall 212 (the end portion on the target 31 side or electron emission direction side) is visible.

Figure 13:
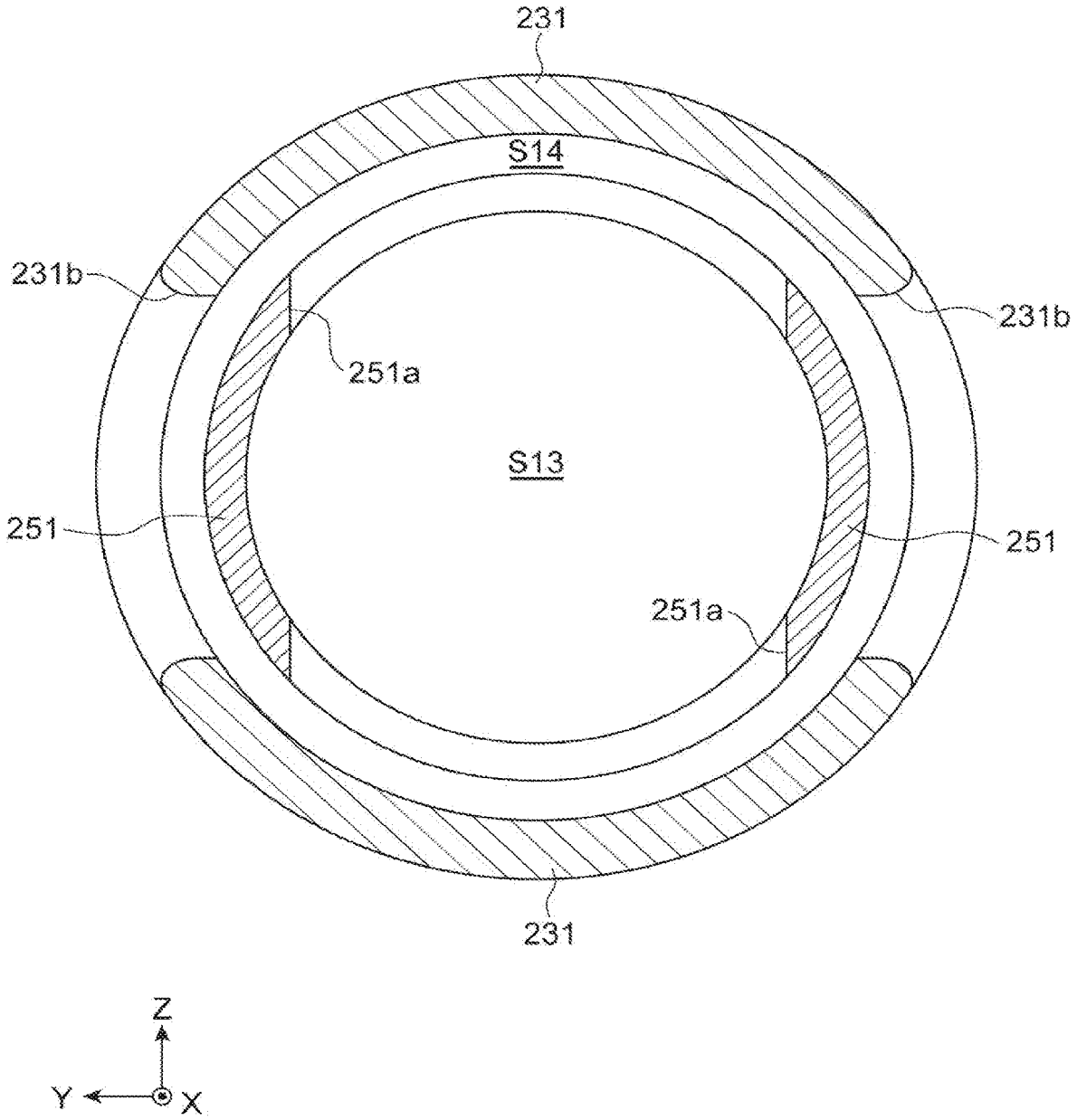
FIG. 13 is a cross-sectional view taken along line XIII-XIII in FIG. 7.

As illustrated in FIG. 13, the space S14 (fourth space) is formed between the side wall 251 and the part of the side wall 231 that faces the side wall 251 of the third holding electrode 25 (that is, a part surrounding the side wall 251). The side wall 231 and the side wall 251 are separated from each other such that a gap is provided between the side wall 231 and the side wall 251. In addition, the opening portion 231*b* (fourth opening portion) is provided at the part of the side wall 231 that faces the side wall 251 (part surrounding the side wall 251). In some examples, a plurality of (two as an example) the opening portions 231*b* are provided in the side wall 231. The two opening portions 231*b* face each other in a direction orthogonal to the emission axis AX (such as the Y-axis direction). Each opening portion 231*b* has an edge portion having a curved shape (R shape) and is formed in a substantially rectangular shape similarly to the opening portion 251*a*. The space S14 between the side wall 251 and the side wall 231 and the external space of the electron gun 2 (e.g. the internal space S1 of the housing 6) communicate with and/or are fluidly coupled to each other via the opening portion 231*b*.

As illustrated in FIG. 13, the opening portion 251*a* provided in the side wall 251 and the opening portion 231*b* provided in the side wall 231 do not directly face each other. In some examples, the position where the opening portion 251*a* is provided deviates by approximately 90 degrees with respect to the position where the opening portion 231*b* is provided when viewed from the X-axis direction. Accordingly, the opening portion 231*b* and the opening portion 251*a* are alternately disposed such that the opening portion 251*a* cannot be visually recognized via the opening portion 231*b* when the electron gun 2 is viewed from the outside.

In some examples, the space S11 in the first grid electrode 21 (the cathode accommodating space accommodating the distal end portion C1 of the cathode C) communicates with the space S12 between the side wall 211 and the side wall 231 of the second grid electrode 23 (part 232*a* of the surrounding portion 232) via the opening portion 211*a* provided in the side wall 211 of the first grid electrode 21. Further, the space S12 communicates with the external space of the electron gun 2 (e.g. internal space S1 of the housing 6) via the opening portion 231*a* provided in the second grid electrode 23. As a result, a gas remaining in the cathode accommodating space (space S11) is discharged to the space S12 via the opening portion 211*a*, and the gas discharged to the space S12 is discharged to the external space of the electron gun 2 (e.g. internal space S1 of the housing 6) via the opening portion 231*a*. Accordingly, the electron gun 2 may be used to efficiently evacuate the cathode accommodating space (space S11). In addition, a gas may also be generated from each member constituting the electron gun 2 (such as the first grid electrode 21), and such a gas can also be efficiently discharged. Accordingly, the electron gun 2 may be configured to evacuate the cathode accommodating space (space S11), and to suppress consumption of the cathode C and inter-member discharge (such as corona discharge between the support pin C2 and each electrode).

The opening portion 211*a* has an elongated hole shape extending along the circumferential direction around the emission axis AX to evacuate the space S11 via the opening portion 211*a*.

The side wall 231 may be configured to cover and hide the opening portion 211*a* when viewed from a direction orthogonal to the emission axis AX (direction along the YZ plane). An edge end portion that constitutes the opening portion 211*a* or the like can be hidden with respect to a structure having a large potential difference from the electron gun, examples of which include the inner wall of the housing 6. As a result, the occurrence of electrical discharge may be suppressed.

The third holding electrode 25 has the side wall 251 surrounding the support portions (pair of support pins C2) supporting the distal end portion C1 of the cathode C around the emission axis AX. The side wall 251 is provided with the opening portion 251*a* allowing the space S13 surrounded by the side wall 251 and the external space of the electron gun 2 (e.g. internal space S1 of the housing 6) to communicate with and/or be fluidly coupled to each other. Accordingly, a gas remaining in the cathode accommodating space (space S13) accommodating the pair of support pins C2 can also be discharged to the external space of the electron gun 2 (e.g. internal space S1 of the housing 6) via the opening portion 251*a*. In addition, a gas may also be generated from each member constituting the electron gun 2 (such as the third holding electrode 25), and such a gas can also be efficiently discharged.

The through hole H allowing the space S11 and the space S13 to communicate with and/or be fluidly coupled to each other may be provided in the electron gun 2 so that the space S13 can be more effectively evacuated.

In some examples, a part of the side wall 231 surrounds the side wall 251 around the emission axis AX. The opening portion 231*b* allowing the space S14 between the side wall 231 and the side wall 251 and the external space of the electron gun 2 (e.g. internal space S1 of the housing 6) to communicate with and/or be fluidly coupled to each other is provided at the part of the side wall 231 that surrounds the side wall 251. The space S13 and the external space of the electron gun 2 (e.g. internal space S1 of the housing 6) communicate with and/or are fluidly coupled to each other via the space S14. Accordingly, a gas remaining in the space S13 can be discharged to the external space of the electron gun 2 (e.g. internal space S1 of the housing 6) via the opening portion 251*a*, the space S14, and the opening portion 231*b* in a structure in which the side wall 231 of the second grid electrode 23 is provided so as to surround the side wall 251 of the third holding electrode 25. In addition, a gas may also be generated from each member constituting the electron gun 2 (such as the third holding electrode 25), and such a gas can also be efficiently discharged.

The opening portion 251*a* and the opening portion 231*b* are provided so as not to face each other. If the opening portion 251*a* and the opening portion 231*b* are provided such that the opening portion 251*a* cannot be visually recognized via the opening portion 231*b*, an edge end portion that constitutes the opening portion 251*a* or the like can be hidden with respect to a structure having a large potential difference from the electron gun 2 to suppress the occurrence of electrical discharge. Example structures that have a large potential difference from the electron gun 2 include the inner wall of the housing 6.

During evaluation experiments conducted using an example X-ray generation apparatus 1 including the electron gun 2, it was confirmed that no electrical discharge occurs at a tube voltage of 160 kV after conditioning. In addition, it was confirmed that the amount of consumption of the cathode crystal constituting the cathode C can be significantly reduced as a result of the non-occurrence of electrical discharge, as compared with the case of adopting a configuration that does not include the opening portion 211*a*, the opening portion 231*a*, the opening portion 251*a*, and the opening portion 231*b*.

It is to be understood that not all aspects, advantages and features described herein may necessarily be achieved by, or included in, any one particular example. Indeed, having described and illustrated various examples herein, it should be apparent that other examples, including those with different materials and shapes, may be modified in arrangement and detail.

For example, the deflection coil 41 described herein may be omitted when the emission axis of the electron beam EB from the electron gun 2 and the central axis of the magnetic focusing lens 42 are aligned with high precision. In addition, the deflection coil 41 may be located between the magnetic focusing lens 42 and the magnetic quadrupole lens 43 or may be located between the magnetic quadrupole lens 43 and the target 31.

The shape of the electron passage P (cylindrical tube 9) may have a single diameter over the entire region. In addition, the electron passage P may be formed by the single cylindrical tube 9. In other examples, the cylindrical tube 9 may be provided only in the housing 6 and the electron passage P passing through the housing 7 may be formed by a through hole provided in the wall portion 71 of the housing 7. In addition, through holes in the tube member 10, the housing 44, and the housing 7 may constitute the electron passage P without the cylindrical tube 9 being separately provided.

Figure 14:
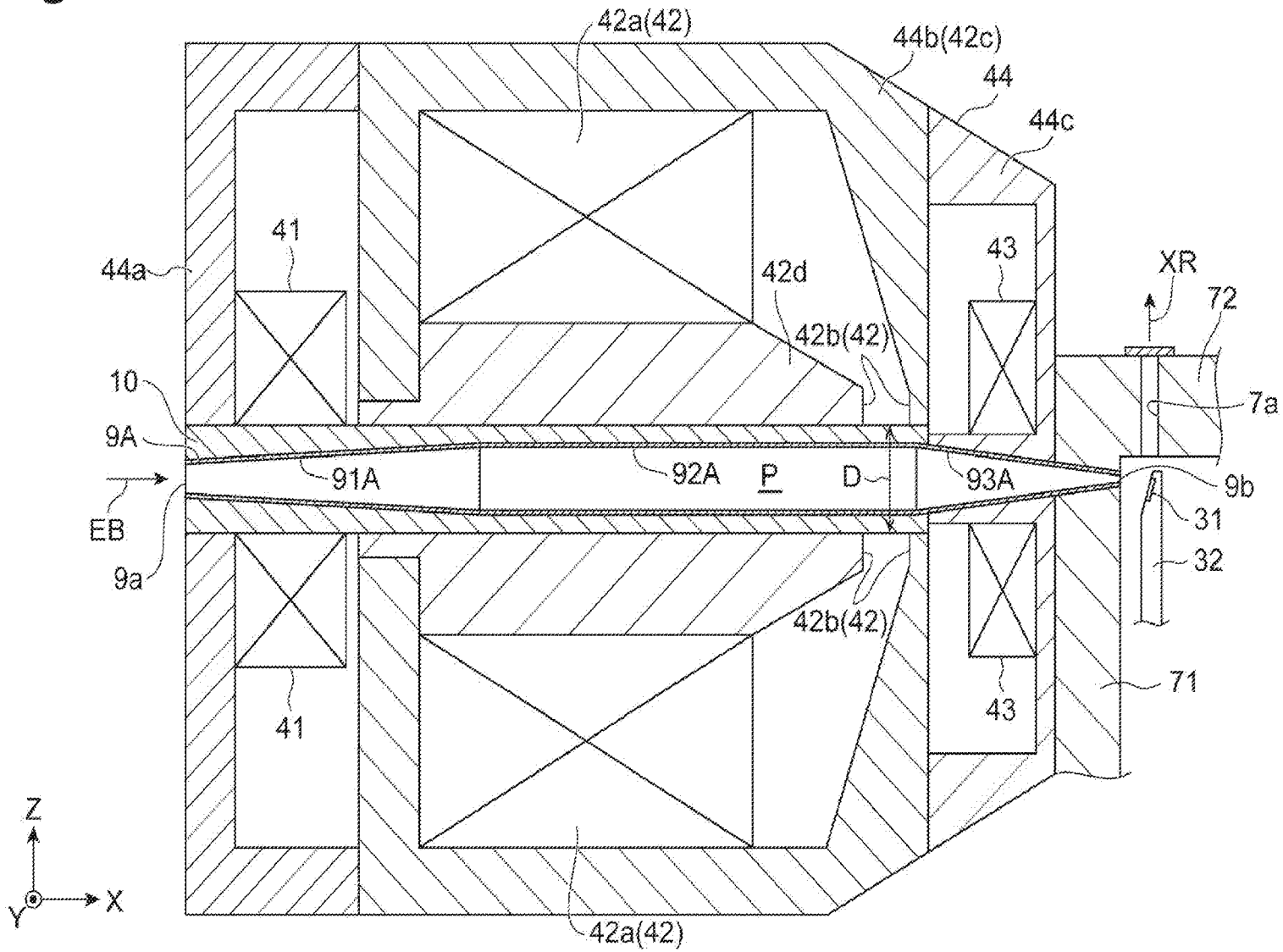
FIG. 14 is a diagram illustrating an example cylindrical tube.

An example cylindrical tube (cylindrical tube 9A) is illustrated in FIG. 14. In some examples, the cylindrical tube 9A differs from the cylindrical tube 9 illustrated in FIG. 2 in that the cylindrical tube 9A has cylindrical portions 91A to 93A instead of the cylindrical portions 91 to 96. The cylindrical portion 91A extends from the end portion 9*a* of the cylindrical tube 9 to the position surrounded by a portion of the coil 42*a* on the electron gun 2 side. The cylindrical portion 91A has a tapered shape. For example, the diameter of the cylindrical portion 91A gradually increases from the diameter d1 to the diameter d2 from the end portion 9*a* toward the target 31 side of the cylindrical portion 91A. The cylindrical portion 92A extends from the end portion of the cylindrical portion 91A on the target 31 side of the cylindrical portion 91A to a position slightly closer to the target 31 than the pole piece 42*b*. The cylindrical portion 92A has a constant diameter (the diameter d2). The cylindrical portion 93A extends from the end portion of the cylindrical portion 92A on the target 31 side of the cylindrical portion 92A to the end portion 9*b* of the cylindrical tube 9. The cylindrical portion 93A has a tapered shape. For example, the diameter of the cylindrical portion 93A gradually decreases from the diameter d2 to the diameter d6 from the end portion of the cylindrical portion 92A toward the target 31 side of the cylindrical portion 93A. In the cylindrical tube 9A, the cylindrical portion 91A corresponds to a diameter-increased portion and the cylindrical portion 93A corresponds to a diameter-reduced portion.

Figure 15:
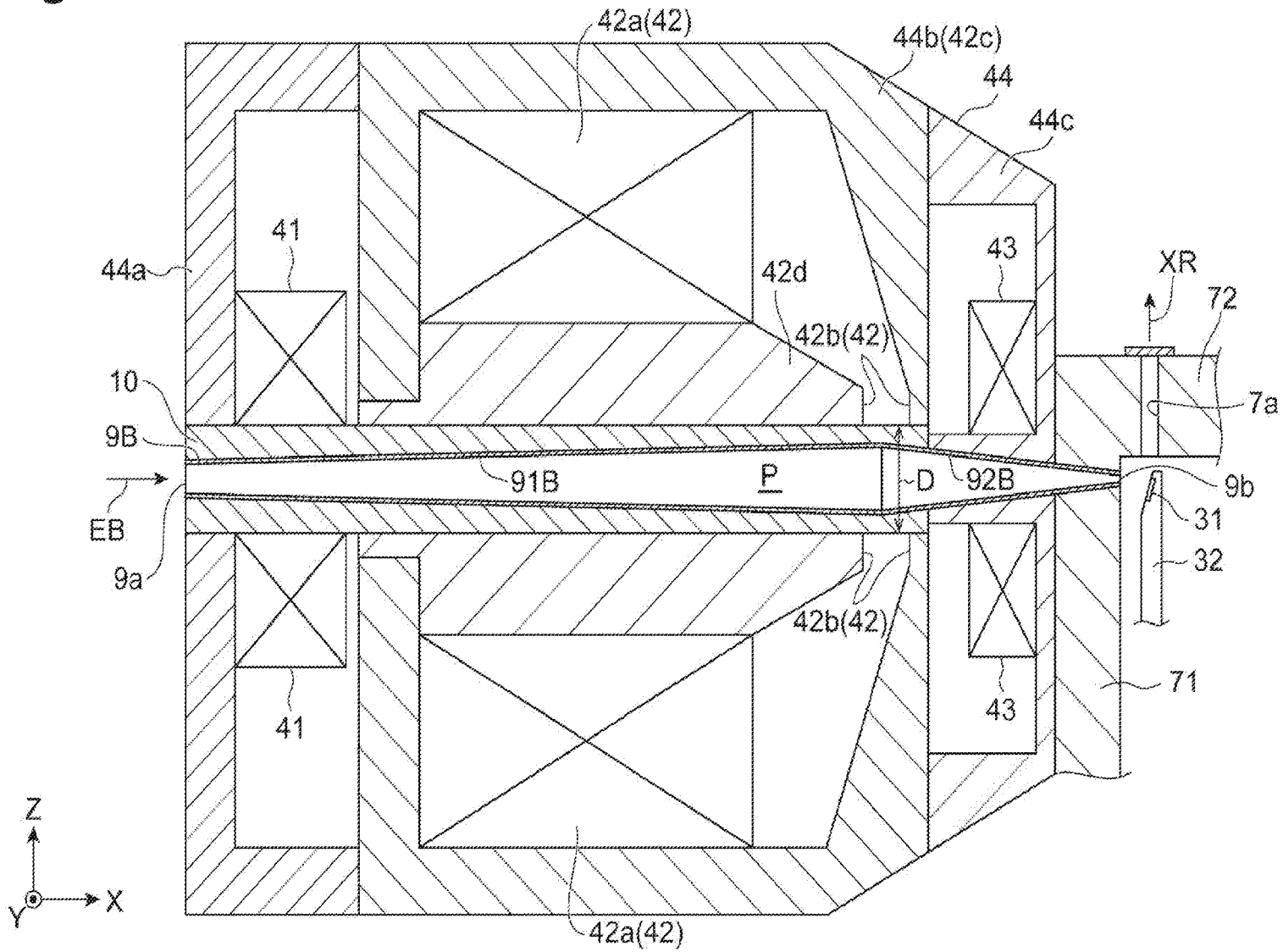
FIG. 15 is a diagram illustrating another example cylindrical tube.
Figure 16:
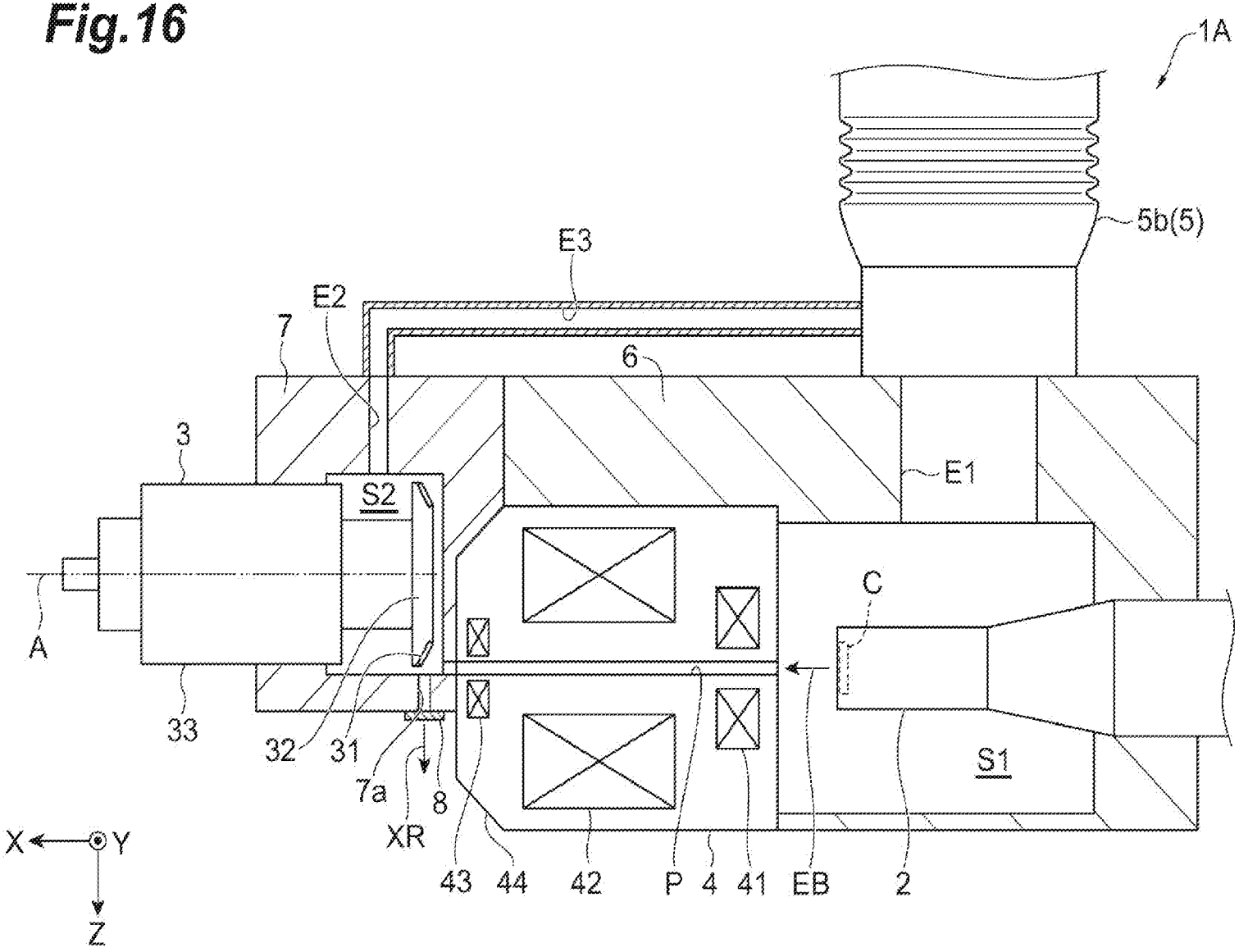
FIG. 16 is a schematic configuration diagram of another example X-ray generation apparatus.

Another example cylindrical tube (cylindrical tube 9B) is illustrated in FIG. 15. In some examples, the cylindrical tube 9B differs from the cylindrical tube 9 illustrated in FIG. 2 in that the cylindrical tube 9B has cylindrical portions 91B and 92B instead of the cylindrical portions 91 to 96. The cylindrical portion 91B extends from the end portion 9*a* of the cylindrical tube 9 to the position surrounded by the pole piece 42*b*. The cylindrical portion 91B has a tapered shape. For example, the diameter of the cylindrical portion 91B gradually increases from the diameter d1 to the diameter d2 from the end portion 9*a* toward the target 31 side of the cylindrical portion 91B. The cylindrical portion 92B extends from the end portion of the cylindrical portion 91B on the target 31 side to the end portion 9*b* of the cylindrical tube 9. The cylindrical portion 92B has a tapered shape. In some examples, the diameter of the cylindrical portion 92B gradually decreases from the diameter d2 to the diameter d6 from the end portion of the cylindrical portion 91B toward the target 31 side of the cylindrical portion 92A. In the cylindrical tube 9B, the cylindrical portion 91B corresponds to a diameter-increased portion and the cylindrical portion 92B corresponds to a diameter-reduced portion.

In some examples, each of the diameter-reduced portion and the diameter-increased portion of the cylindrical tube (electron passage) may have a tapered shape, as in the example cylindrical tubes 9A and 9B, instead of a stepped (discontinuous) shape as in the example cylindrical tube 9. In addition, a tapered part may constitute the cylindrical tube alone as in the cylindrical tube 9B. In addition, the cylindrical tube may have both a part where the diameter changes in a stepped manner and a part where the diameter changes in a tapered shape. For example, the diameter-reduced portion may be formed in a stepped manner as in the cylindrical tube 9 with the diameter-increased portion formed in a tapered shape as in the cylindrical tube 9A.

Further, the target may not be a rotary anode. In some examples, the target may be configured not to rotate and the electron beam EB may be configured to be incident at the same position on the target at all times. When the target is a rotary anode, local load to the target by the electron beam EB can be reduced. As a result, the amount of the electron beam EB and the dose of the X-ray XR emitted from the target may be increased.

In some examples, the electron gun 2 may be configured to emit the electron beam EB having a circular cross-sectional shape. In other examples, the electron gun 2 may be configured to emit an electron beam having a non-circular cross-sectional shape.

In some examples, the electron gun 2 may not be provided with all of the opening portions 211*a*, 231*a*, 251*a*, and 231*b* described above. For example, the opening portion 251*a* and the opening portion 231*b* may be omitted such that the exhaust efficiency of the space S11 is provided by the opening portion 211*a* and the opening portion 231*a*. In addition, one or more of the opening portions 211*a*, 231*a*, 251*a*, and 231*b* and the through hole H may be altered or changed in terms of shape, number, and disposition. In addition, the through hole H may allow the space S12 and the space S13 to communicate with and/or be fluidly coupled to each other. The position where the through hole H is formed may be a position overlapping the space S12 when viewed from the X-axis direction (that is, a position outside the position illustrated in FIG. 9 and located away from the emission axis AX).

What is claimed is:

1. An electron beam generator comprising:

a cathode having a distal end portion configured to emit an electron beam;

a first electrode accommodating the distal end portion of the cathode, the first electrode including a first side wall surrounding the distal end portion around an emission axis of the electron beam; and a second electrode surrounding the first electrode when viewed from a direction along the emission axis, the second electrode including a second side wall separated from and surrounding the first side wall, wherein the first side wall is provided with a first opening portion that fluidly couples a first space surrounded by the first side wall to a second space located between the first side wall and the second side wall, and wherein the second electrode is provided with a second opening portion that opens in the direction along the emission axis and that fluidly couples the second space and an external space of the electron beam generator.

2. The electron beam generator according to claim 1, wherein the first opening portion has an elongated hole shape that extends along a circumferential direction around the emission axis.

3. The electron beam generator according to claim 1, wherein the second side wall is configured to cover and hide the first opening portion when viewed from a direction orthogonal to the emission axis.

4. The electron beam generator according to claim 1, further comprising a third electrode having a third side wall surrounding a support portion that supports the distal end portion of the cathode, the third side wall surrounding the support portion around the emission axis, wherein the third side wall is provided with a third opening portion that fluidly couples a third space surrounded by the third side wall to the external space.

5. The electron beam generator according to claim 4, further comprising a through hole that fluidly couples the third space to at least one of the first space and the second space.

6. The electron beam generator according to claim 4, further comprising a fourth opening portion that fluidly couples the external space to a fourth space located between the second side wall and the third side wall, the fourth opening portion provided at a part of the second side wall that surrounds the third side wall, wherein the third space and the external space are fluidly coupled to each other via the fourth space.

7. The electron beam generator according to claim 6, wherein the third opening portion and the fourth opening portion do not face each other.

8. The electron beam generator according to claim 4, wherein the first electrode comprises a first grid electrode, wherein the second electrode comprises a second grid electrode, and wherein the third electrode comprises a holding electrode.

9. The electron beam generator according to claim 8, further comprising:

a first holding electrode connected to the first grid electrode; and a second holding electrode connected to the first holding electrode, wherein the first holding electrode is located between the first grid electrode and the second holding electrode.

10. The electron beam generator according to claim 9, wherein the first holding electrode comprises a disk-shaped metallic electrode.

11. The electron beam generator according to claim 9, wherein the first holding electrode includes a plurality of circular through holes provided at equal intervals along a circumferential direction around the emission axis.

12. The electron beam generator according to claim 11, wherein the plurality of the circular through holes is configured to fluidly couple the third space to at least one of the first space and the second space.

13. The electron beam generator according to claim 11, wherein the second holding electrode comprises a cylindrical shaped side wall and an annular shaped flange portion.

14. The electron beam generator according to claim 13, wherein an outer edge of the annular shaped flange portion is positioned inside an edge portion of at least one of the circular through holes.

15. The electron beam generator according to claim 9, wherein the first holding electrode is provided with a central opening portion that is positioned on the emission axis, and wherein the electron beam generator further comprises a stem that supports the cathode and that is inserted into the central opening portion.

16. The electron beam generator according to claim 15, wherein the second holding electrode comprises a cylindrical shaped side wall, and wherein an outer surface of the stem that protrudes from the central opening portion is joined to an inner surface of the cylindrical shaped side wall.

17. The electron beam generator according to claim 1, wherein the second space located between the second side wall and the first side wall forms an annular gap.

18. The electron beam generator according to claim 1, wherein the distal end portion of the cathode is located in the first space.

19. The electron beam generator according to claim 1, wherein the distal end portion of the cathode is configured to emit the electron beam into the external space.

20. An X-ray generation apparatus comprising the electron beam generator according to claim 1.

* * * * *